US006537185B1

(12) United States Patent
Hur

(10) Patent No.: US 6,537,185 B1
(45) Date of Patent: Mar. 25, 2003

(54) EXERCISE DEVICE

(76) Inventor: Young-Baek Hur, 214, Jangsa-Dong, Jongro-Ku, Seoul (KR), 110-430

( * ) Notice: Subject to any disclaimer, the term of this patent is extended or adjusted under 35 U.S.C. 154(b) by 0 days.

(21) Appl. No.: 09/402,300

(22) PCT Filed: Apr. 2, 1998

(86) PCT No.: PCT/KR98/00079

§ 371 (c)(1),
(2), (4) Date: Oct. 1, 1999

(87) PCT Pub. No.: WO98/43707

PCT Pub. Date: Oct. 8, 1998

(30) Foreign Application Priority Data

May 16, 1997 (KR) ..... 97-18979
Apr. 2, 1997 (KR) ..... 97-12250
Mar. 20, 1998 (KR) ..... 98-9565

(51) Int. Cl.[7] ..... A63B 26/00; A63B 21/068; A63B 21/02

(52) U.S. Cl. ..... 482/142; 482/121; 482/96

(58) Field of Search ..... 482/142, 121, 482/122, 123, 125, 126, 129, 130, 72, 148

(56) References Cited

U.S. PATENT DOCUMENTS 4,169,589 A 10/1979 McArthur ..... 272/118
5,037,090 A * 8/1991 Fitzpatrick ..... 272/134
5,070,863 A * 12/1991 McArthur et al. ..... 128/25 R
5,171,295 A 12/1992 Schwalm, Jr. ..... 482/131
5,338,274 A * 8/1994 Jones ..... 482/100
5,429,572 A 7/1995 Brown et al. ..... 482/116
5,498,222 A 3/1996 Hur ..... 482/112
5,669,865 A * 9/1997 Gordon ..... 482/142

FOREIGN PATENT DOCUMENTS

WO WO 89/01 353 A1 2/1989 ..... A63B/21/00

* cited by examiner

*Primary Examiner*—Michael A. Brown
*Assistant Examiner*—Lori Baker Amerson
(74) *Attorney, Agent, or Firm*—Nawrocki, Rooney & Sivertson, P.A.

(57) ABSTRACT

An exercise device having a simple and inexpensive configuration including an exercise load unit connected to a movable knee hold unit, and a seat unit having a seat plate and a back plate which are selectively or completely movable during an exercise, irrespective of whether or not a leg support unit having foot holders is in a fixed state or in a movable state, thereby being capable of achieving a variety of exercises for the whole part of the human body using the upper body or lower body, or using both the upper and lower bodies.

14 Claims, 29 Drawing Sheets

EXERCISE DEVICE

TECHNICAL FIELD

The present invention relates to an exercise device capable of achieving an exercise of human body about the trunk of the human body using the upper part or both the upper and lower parts of the human body, and more particularly to an exercise device capable of effectively carrying out an exercise of wrist joints and trunk using arms and legs.

BACKGROUND ART

Most of known exercise devices are configured to be used for exercises of individual parts of human body. Where it is desired to obtain exercises of various parts of human body, a plurality of exercise devices respectively required for those exercises should be used. However, this is expensive. Although exercise devices having a multiple exercise function are also known, they have a configuration in which a plurality of exercise mechanisms having different exercise functions are simply combined. In such exercise devices, accordingly, it is impossible to expect an effect of an exercise of the whole body through exercises of individual parts of the body obtained by the exercise mechanisms.

In order to solve the above mentioned problems, an exercise device has also been proposed in U.S. Pat. No. 5,498,222 issued to the inventor. This exercise device includes a common load unit which has an independent or common use for several exercises suitable for various parts of human body. The exercise device has an advantage in that a variety of exercises for individual parts of human body can be achieved. This exercise device also includes a pair of levers and a leg support unit. In accordance with upward and downward movements of the levers, an exercise of wrist joints is carried out. However, the levers should be operatively connected in order to return the levers positioned at their upper position to their lower position. For such an operative connection, additional elements should be used. This results in a complexity of the overall construction and an increase in the manufacturing costs. Due to such problems, there is also a limited utility.

The leg support unit of the exercise device disclosed in the patent is constructed to be movable. The exercise device also includes a knee hold unit constructed to be movable. The exercise device further includes a seat plate and a back plate which are constructed to adjust the height or inclination thereof while being fixed during an exercise. Accordingly, exercises can be carried out using the lower part or upper part of the body in this exercise device. However, where an exercise using only the lower part of the body is carried out, little movement of the upper part of the body occurs. For this reason, the exercise device has a drawback in that it is impossible to carry out an exercise of the whole body using both the upper and lower parts of the body.

Referring to FIG. 43, a conventional seat unit applied to exercise devices is illustrated. As shown in FIG. 43, the seat unit includes a seat plate 102 and a back plate 104. Where the seat plate 102 and back plate 104 are hingably connected to each other by a hinge 150, there is a height difference between the hinge and the upper surface of the seat plate 102 or back plate 104. When the back plate 104 moves hingably with respect to the seat plate 102, the facing ends of the seat plate 102 and back plate 104 get near or away from each other due to the height difference between the hinge and the upper surface of the seat plate 102 or back plate 104. Where an exercise is carried out using an exercise device, to which the above seat unit is applied, while the back plate 104 moves hingably with respect to the seat plate 102, an unbalance occurs between the movement of the body and the movement of the seat unit because the movement center of the seat unit, namely, the position of the hinge 150, is spaced from the movement center of the body, namely, the center of the wrest joint. For this reason, there is an inconvenience in the exercise. For example, the shirt of the user may be taken off during the exercise.

DISCLOSURE OF THE INVENTION

Therefore, the present invention has been made in view of the above mentioned problems involved in conventional exercise devices, and an object of the invention is to provide an exercise device having a simple and inexpensive configuration including an exercise load unit connected to a movable knee. hold unit, and a seat unit having a seat plate and a back plate which are selectively or completely movable during an exercise, irrespective of whether or not a leg support unit having foot holders is in a fixed state or in a movable state, thereby being capable of achieving a variety of exercises for the whole part of the human body using the upper body or lower body, or using both the upper and lower bodies.

Another object of the invention is to provide an exercise device having a configuration not only including an exercise load unit comprised of the weight of a user transmitted to a movable frame of the exercise device during an exercise or a variety of load units, the exercise load unit being connected to a knee hold unit via a load transmission unit, thereby, being capable of selectively transmitting an exercise load to knee holders in accordance with the direction of an exercise such as an extension or flection exercise, but also including an initial exercise thrust generating unit connected between a movable frame of a seat unit and a fixed frame and adapted to generate a thrust for exercise at the initial stage of the exercise.

Another object of the invention is to provide an exercise device having a configuration including a distance adjusting unit adapted to adjust the distances between a foot holder and a knee holder, between the knee holder and a seat plate and between the foot holder and seat plate in accordance with the lengths between the foot and knee of the user and between the knee and wrist joint, thereby being capable of meeting the body length and shape of the user.

Another object of the invention is to provide an exercise device having a configuration including an upper body flection/extension exercise unit connected to the back plate frame of a seat unit and adapted to achieve a flection or extension exercise for the upper body of the user, thereby achieving an exercise for the epigastric muscle of the user.

Another object of the invention is to provide an exercise device having a configuration including a knee holder moving unit adapted to temporarily move knee holders, thereby providing a space for allowing the user to sit down on the exercise device to carry out an exercise or to rise up from the seat plate after the exercise.

Another object of the invention is to provide an exercise device having a configuration including a foot holder pressure adjusting unit adapted to not only achieve a flection exercise only using the knees of the user under the condition in which no considerable resistance is applied to the feet of the user, but also to achieve an exercise for the crook muscle of the user.

Another object of the invention is to provide an exercise device having a configuration including a shift preventing unit adapted to prevent the seat and back plates of a seat unit from being spaced from each other when the angle defined between the plates varies, thereby being capable of adapting the heap and back portions of the user about his wrist joints to the seat and back plates of the seat unit about their hinges.

Another object of the invention is to provide an exercise device having a configuration including a repeated extension/retraction exercise unit which can be used in combination with or independently of exercise devices according to the present invention, the repeated extension/retraction exercise unit including an exercise load transmitting unit comprised of a rope or wire and being adjustable in length, thereby being capable of achieving an exercise for the body such as an exercise for the latissimus dorsi muscle and an exercise for the dorsal muscle in various exercise directions.

In order to accomplish the above objects, the present invention provides an exercise device comprising a seat unit having a seat plate, a back plate, support legs and associated frames completely or selectively assembled together, a leg support unit having foot holders, and a knee hold unit, the exercise device carrying out an exercise using the leg support unit and the knee hold unit, further comprising: means for allowing the knee hold unit to be movable; exercise load means connected to the movable knee hold unit; means for allowing the leg support unit to be selectively movable or fixed during an exercise; and means for allowing a selected one or all of the seat and back plates of the seat unit to be selectively movable or fixed during an exercise.

The present invention also provides an exercise device comprising, completely or selectively in combination, initial exercise thrust generating means, distance adjusting means, upper body flection/extension exercise means, knee holder moving means, repeated extension/retraction exercise means, foot holder pressure adjusting means, and shift preventing means.

BRIEF DESCRIPTION OF THE DRAWINGS

The above and other objects, features and other advantages of the present invention will be more clearly understood from the following detailed description taken in conjunction with the accompanying drawings, in which:

FIGS. 5 to 7 are views showing a distance adjusting unit included in the device of FIG. 1, respectively, in which:

FIG. 5 is a partially sectioned side view showing the operation of the distance adjusting unit;

FIG. 6 is a side sectional view showing the operation of a control knob unit included in the distance adjusting unit; and FIG. 7 is a side sectional view showing the operation of an assistant distance adjusting unit;

FIGS. 9 to 18 are views showing a repeated extension/retraction exercise unit included in the device of FIG. 1, respectively, in which:

FIG. 9 is a plan view showing the construction of the repeated extension/retraction exercise unit;

FIG. 10 is a sectional view of the repeated extension/retraction exercise unit of FIG. 9;

FIG. 11 is a perspective view showing a direction change roller included in the above unit;

FIG. 12 is a sectional view showing the operation of the direction charge roller of FIG. 11;

FIGS. 13 and 14 are views showing a rope length adjusting unit included in the repeated extension/retraction exercise unit, respectively, in which FIG. 13 is a plan view showing the construction of the rope length adjusting unit, and FIG. 14 is a plan view showing the operation of the rope length adjusting unit;

FIGS. 15 and 16 are views showing a rope length adjusting unit in accordance with another embodiment of this invention, respectively, in which FIG. 15 is a partially broken plan view of the rope length adjusting unit, and FIG. 16 is a sectional view of the rope length adjusting unit;

FIGS. 17 and 18 are views showing a rope length adjusting unit in accordance with a further embodiment of this invention, respectively, in which FIG. 17 is a longitudinal sectioned view of the rope length adjusting unit, and FIG. 18 is a cross sectioned view of the rope length adjusting unit;

FIGS. 19 to 23 are views showing an exercise device in accordance with the second embodiment of the present invention, respectively, in which:

FIG. 19 is a perspective view showing the construction of the above exercise device;

FIGS. 20 and 21 are side views showing the operation of the exercise device of FIG. 19, with a seat plate, a back plate and an upper plate being mounted to a seat unit of the device;

FIGS. 22 and 23 are views of a knee holder moving unit included in the above exercise device, respectively, in which FIG. 22 shows the construction of the knee holder moving unit at a position around a length adjusting unit adapted to adjust the load transmission unit, and FIG. 23 shows the construction of the knee holder moving unit at a position around a spring interposed between a connecting bar and a leg support bar;

FIGS. 25 to 27 are views showing a shift preventing unit included in the above exercise device, respectively, in which:

FIG. 25 is a side view showing the operation of the unit when the back plate pivots forwardly;

FIG. 26 is a side view showing the operation of the unit when the back plate pivots backwardly; and FIG. 27 is a side view of the exercise device with the above shift preventing unit;

FIGS. 30 to 34 are views of a repeated extension/retraction exercise unit in accordance with a further embodiment of the present invention, respectively, in which:

FIG. 30 is a plan view of the repeated extension/retraction exercise unit;

FIG. 31 is a side view showing the operation of the repeated extension/retraction exercise unit;

FIG. 32 is a sectional view showing the construction of the repeated extension/retraction exercise unit at a position around a foot holder;

FIG. 33 is a sectional view showing the construction of the repeated extension/retraction exercise unit at a position around a fixing unit; and FIG. 34 is a partially enlarged view of the portion "A" of FIG. 33;

FIGS. 35 to 39 are views of a repeated extension/retraction exercise unit in accordance with a still another embodiment of the present invention, respectively, in which:

FIG. 35 is a partially broken side view of the repeated extension/retraction exercise unit;

FIG. 36 is a partially broken plan view of FIG. 35;

FIG. 37 is a sectional view showing the construction of the repeated extension/retraction exercise unit at a position around a shift unit;

FIG. 38 is a sectional view showing the construction of the repeated extension/retraction exercise unit at a position around a seat plate; and FIG. 39 is a sectional view showing the construction of the repeated extension/retraction exercise unit at a position around a load adjusting unit;

FIGS. 40 to 42 are views of a repeated extension/retraction exercise unit in accordance with a still another embodiment of the present invention, respectively, in which:

FIG. 40 is a longitudinal sectioned view of the repeated extension/retraction exercise unit;

FIG. 41 is a cross sectioned view of the repeated extension/retraction exercise unit; and FIG. 42 is a plan view showing the construction of the repeated extension/retraction exercise unit at a position around a load adjusting unit;

BEST MODE FOR CARRYING OUT THE INVENTION

Figure 1:
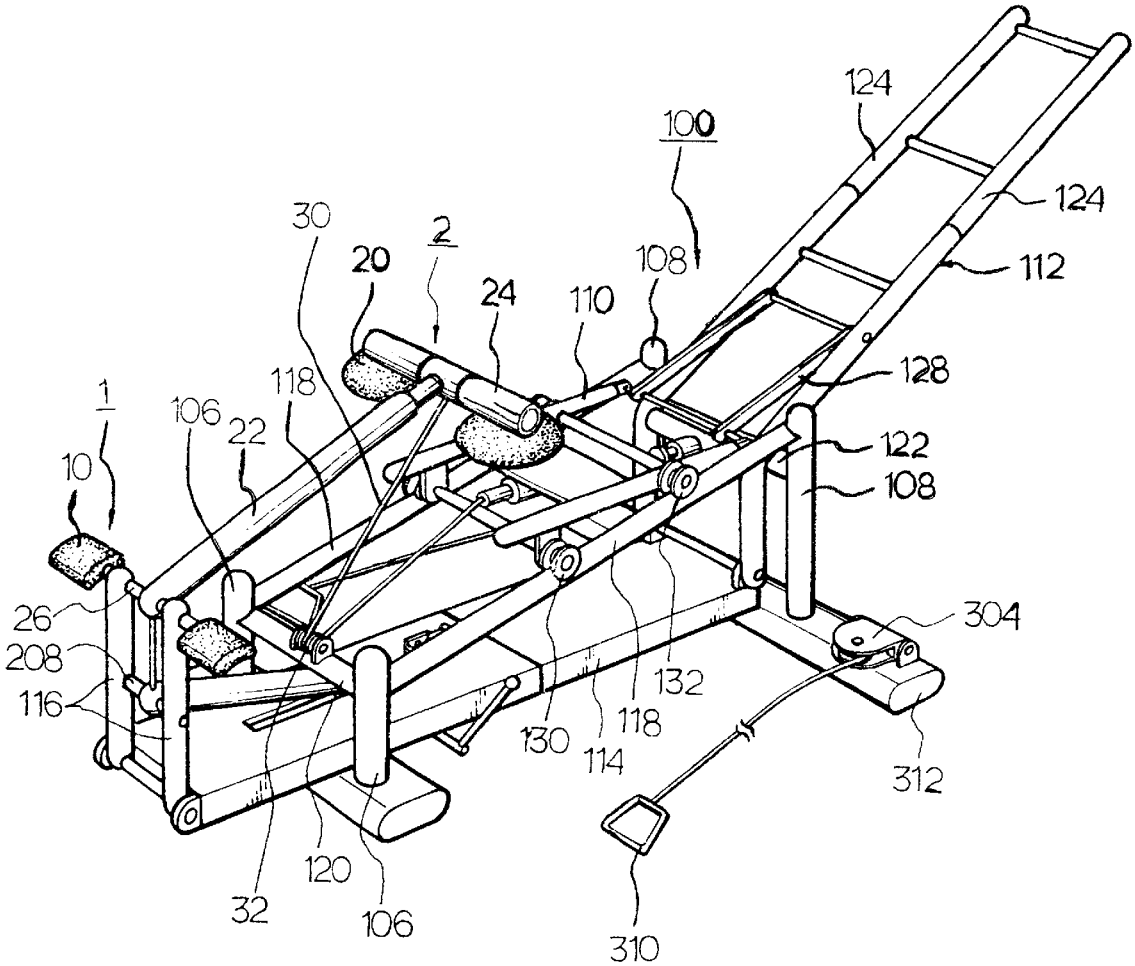
FIG. 1 is a perspective view showing the construction of an exercise device in accordance with the primary embodiment of the present invention.

Referring to FIGS. 1 to 35, various embodiments of an exercise device in accordance with the present invention are illustrated. The embodiment of FIGS. 1 to 18 is distinguished from the embodiment of FIGS. 19 to 23 in accordance with whether a leg support unit provided with foot holders is in a fixed state or in a movable state. The embodiments of FIGS. 9 to 18 and FIGS. 24 to 35 illustrate a variety of exercise devices for repeated extension and retraction exercises which can be used in combination with or independently of the exercise devices of the above mentioned embodiments.

First, the exercise device of the present invention will be described in conjunction with the embodiment of FIGS. 1 to 23. As shown in FIGS. 1 to 23, the exercise device of the present invention includes a seat unit 100 including a seat plate 102, back plates 104 and 126, support legs 106 and 108, and associated frames 110 and 112, which are wholly or selectively assembled together. The exercise device also includes a leg support unit 1 and a knee hold unit 2 in order to carry out an exercise at the sitting or lying status of the user. The knee hold unit 2 is movable and includes knee holders 20. An exercise load unit 3 is connected to the knee hold unit 2. The leg support unit 1 may be configured to be fixed or movable during an exercise. The leg support unit 1 is provided with foot holders 10. The seat plate 102f back plate 104 and 126 and other elements of the seat unit 10 may also be configured to be fixed or movable during an exercise.

In the case of the embodiment illustrated in FIGS. 1 to 18, the leg support unit 1, which includes the foot holders 10, is configured to be fixed during an exercise. In this case, the seat unit 100 includes movable frames in which the seat plate 102 and back plates 104 and 126 are included. The movable frames are configured to be movable during an exercise.

In accordance with this embodiment, the foot holders 10 of the leg support unit 1 are fixedly mounted on a pair of spaced vertical bars 116 fixed to the front end of a fixed rectangular base frame 114, respectively. The seat unit 100 includes a pair of laterally spaced longitudinal bars 118 each fixedly mounted at both ends thereof to respective upper ends of the associated front and rear vertical legs 106 and 108. The front vertical legs 106 are connected to each other by a lateral bar 120 whereas the rear vertical legs 108 are connected to each other by a lateral bar 122. The seat unit 100 also includes a back plate frame 112 hingably mounted at the front end thereof to the rear portion of the fixed base frame 114 at a position in front of the lateral bar 122. The back plate frame 122 has a pair of laterally spaced longitudinal bars 124. An assistant back plate frame 128 is hingably mounted at the rear end thereof to the middle portions of the longitudinal bars 124 of the back plate frame 112 between the longitudinal bars 124. The seat unit 100 further includes a seat plate frame 120 hingably mounted at the rear end thereof to the front end of the assistant back plate frame 128 and provided at the front and rear portions thereof with front and rear rollers 130 and 132 adapted to slide on the longitudinal bars 118.

As mentioned above, the knee hold unit 2 includes a pair of knee holders 20. The knee hold unit 2 also includes a connecting bar 22 hingably mounted at the front end thereof to a lateral bar 26 connecting the vertical bars 116 to each other. A knee holder supporting bar 24 is mounted to the rear end of the connecting bar 22. The knee holders 20 are attached to opposite side portions of the knee holder supporting bar 24 at the lower surface of the knee holder supporting bar 24. Thus, the knee hold unit 2 is configured to be movable.

Figure 2:
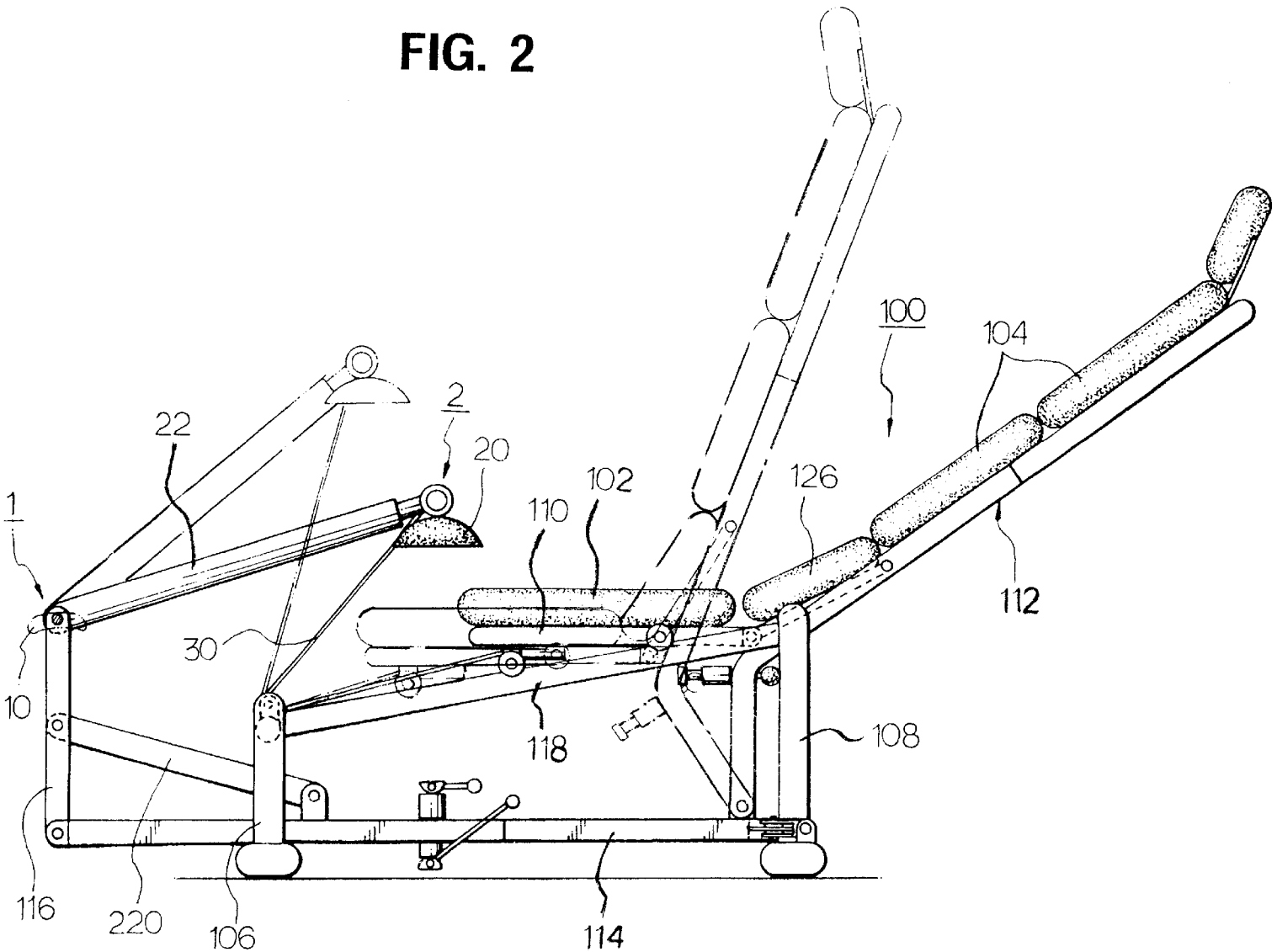
FIG. 2 is a side view showing the operation of the exercise device of FIG. 1, with a seat plate, a back plate and an upper plate being mounted to a seat unit of the device.
Figure 3:
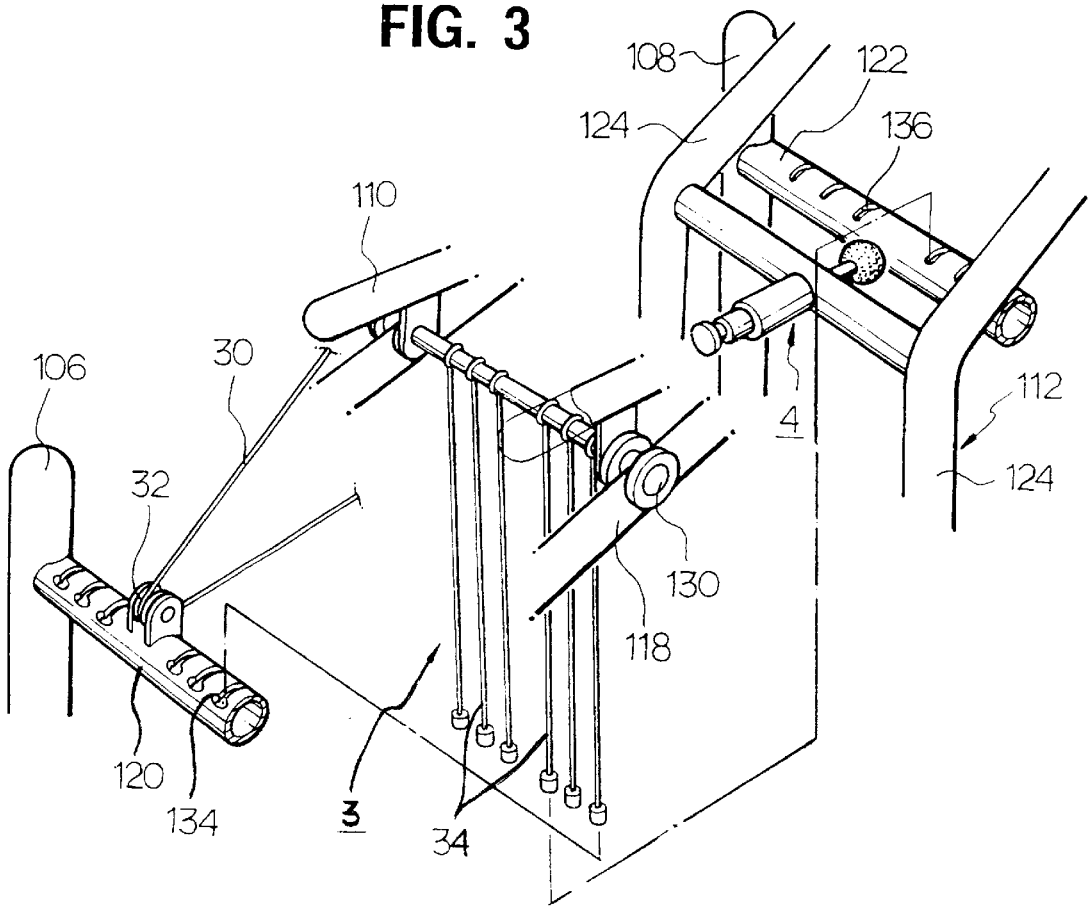
FIG. 3 is a perspective view showing an exercise load unit and an initial exercise thrust generating unit of the above device.

As shown in FIGS. 1 and 2, the exercise load unit 3 is connected to the knee hold unit 2 by a rope type load transmission unit 30. The load transmission unit 30 includes an idle roller 32 mounted to the lateral bar 120 connecting the front vertical legs 106, and a rope connected at both ends respectively to the knee hold unit 2 and seat unit 100 while being wound on the idle roller 32. When the user moves upwardly and forwardly the knee holders 20 about the hinge at the front end of the connecting bar 22 by his knees under the condition in which his feet are laid on the foot holders 10 while his knees are held on the knee holders 20, the weight of the user applied to the movable frames of the seat unit 100 including the seat plate 102 and back plate 104 is transmitted to the knee hold unit 2 via the rope and idle roller 32 of the load transmission unit 30 while the seat plate 102 and back plate 104 move forwardly. Accordingly, the weight of the user serves as an exercise load for the knee hold unit 2. As shown in FIG. 3, a separate load unit 34, which includes a plurality of elastic members, may be connected between the seat plate frame 110 and the lateral bar 120 connecting the front vertical legs 106 or lateral bar 122 connecting the rear vertical legs 108, in order to operatively connect the upward and downward movements of the knee holders 20 with the forward and rearward movements of the seat plate 102 and back plates 104 and 126, thereby generating an effect of exercise load for the knee hold unit 2.

Although not shown, in addition to the weight of the user or the load unit 34, the exercise load unit 3 may comprise other appropriate means such as hydraulic or pneumatic cylinders, springs or weights. Although the exercise load unit 3 is connected to the knee hold unit 2 via the load transmission unit 30 where it comprises the weight of the user or the load unit 34, it may be connected between a desired movable frame of the seat unit 100 such as the seat plate frame 110 and a desired fixed frame such as the lateral bar 120 connecting the front vertical legs 106 or lateral bar 122 connecting the rear vertical legs 108. Although not shown, the exercise load unit 3 may also be directly connected to the knee hold unit 2.

The connection of the load unit 34 may be changed in accordance with the direction of an exercise to be carried out. For example, each member of the load unit 34 is fixed at one end thereof to a desired movable frame of the seat unit 100, namely, the seat plate frame 110, and engaged at the other end thereof in an associated one of engaging holes 134 provided at the lateral bar 120 connecting the front vertical leg 106 or in an associated one of engaging holes 136 provided at the lateral bar 122 connecting the rear vertical leg 108. By this configuration, during an extension or flection exercise about the wrist joints, an exercise load can be selectively transmitted to the foot holders 10 or knee 7 holders 20.

The number of elastic members of the load unit 34 may be appropriately selected in order to adjust the exercise load of the load unit 34. Although not shown, a variety of conventional load units may be selectively used in accordance with the load for a desired exercise. Where the load unit used has a function capable of adjusting the exercise load, it can be more conveniently used.

The exercise device of the present invention also includes an initial exercise thrust generating unit 4, a distance adjusting unit 200 for adjusting the distance between operatively connected elements of the exercise device in accordance with the length of the body between the foot and knee or between the knee and wrist joint, an upper body flection/extension exercise unit 5 for carrying out an exercise for the epigastric muscle, a knee holder moving unit 6 for moving the knee holders 20 to provide a space for allowing the user to sit down on the exercise device or to rise up from the exercise device, and a repeated extension/retraction exercise unit 300 for carrying out an exercise for the latissimus dorsi muscle and dorsal muscle while adjusting the exercise load in accordance with a desire of the user., As shown in FIGS. 1 to 4, the initial exercise thrust generating unit 4 is installed between a desired movable frame of the seat unit 100 and a desired fixed frame. In the case illustrated in FIGS. 3 and 4, the initial exercise thrust generating unit 4 is mounted to the back plate frame 112. In this case, the initial exercise thrust generating unit 4 includes an outer casing 40 fixedly mounted at one end thereof to a lateral bar 138 of the back plate frame 112, and an actuating rod 43 extending longitudinally through the outer casing 40 and through a hole formed in the lateral bar 138. A damper 42 mounted to the rear end of actuating rod 43 extending rearwardly beyond the lateral bar 138. A slide member 44 is slidably fitted around the actuating rod 43 and received at the rear end thereof in the outer casing 40. In the outer casing 40, a compression coil spring 41 is arranged between the front end of the outer casing 40 and the rear end of the slide member 44 to urge the slide member 44 in the rearward direction. The actuating rod 43 is provided with a stopper 45 at its front portion forwardly protruded from the outer casing 40. The slide member 44 has an engaging slot 46 for receiving the stopper 45 of the actuating rod 43, thereby coupling the slide member 44 to the actuating rod 43. A control knob 47 is mounted to the front end of the actuating rod 43 to engage the stopper 45 of the actuating rod 43 in the engaging slot 46 of the slide member 44 or to disengage the stopper from the engaging slot 46.

At the initial stage of an exercise using the knee hold unit 2, the knee holders 20 and back plate 104 rise as indicated by the double-dotted line in FIG. 2. When the knee holders 20 and back plate 104 move downwardly from the initial state to a state indicated by the solid line in FIG. 2 as the exercise proceeds, the bumper 42 of the initial exercise thrust generating unit 4 comes into contact with the lateral bar 122 connecting the rear vertical legs 108, thereby causing the actuating rod 43 to stop its rearward movement. As the downward movement of the back plate 104 further proceeds, the outer casing 40 fixed to the lateral bar 138 of the back plate frame 112 moves rearwardly along with the back plate frame 112 while compressing the compression coil spring 41. At this time, the slide member 44 is maintained at a state coupled to the actuating rod 43. When the knee holders 20 rise again along with a forward movement of the back plate frame 112, the resilience of the compression coil spring 41 serves as a thrust for exercise. Where the stopper 45 is in a state disengaged from the engaging slot 46 in accordance with an operation of the control knob 47, the slide member 44 is released from the actuating rod 43, so that it is released from the resilience of the compression coil spring 41. In this case, no thrust effect is obtained.

The initial exercise thrust generating unit 4 may comprise spring means or other appropriate elastic means. Although the initial exercise thrust generating unit 4 is installed on the back plate frame 112 which is a movable frame of the seat unit 100, it may be installed on a desired fixed frame of the seat unit 100, for example, the lateral bar 122 connecting the rear vertical leg 108. The initial exercise thrust generating unit 4 may be installed at other appropriate location between the movable and fixed frames of the seat unit 100 in so far as the operation thereof is achieved as desired.

Figure 5:
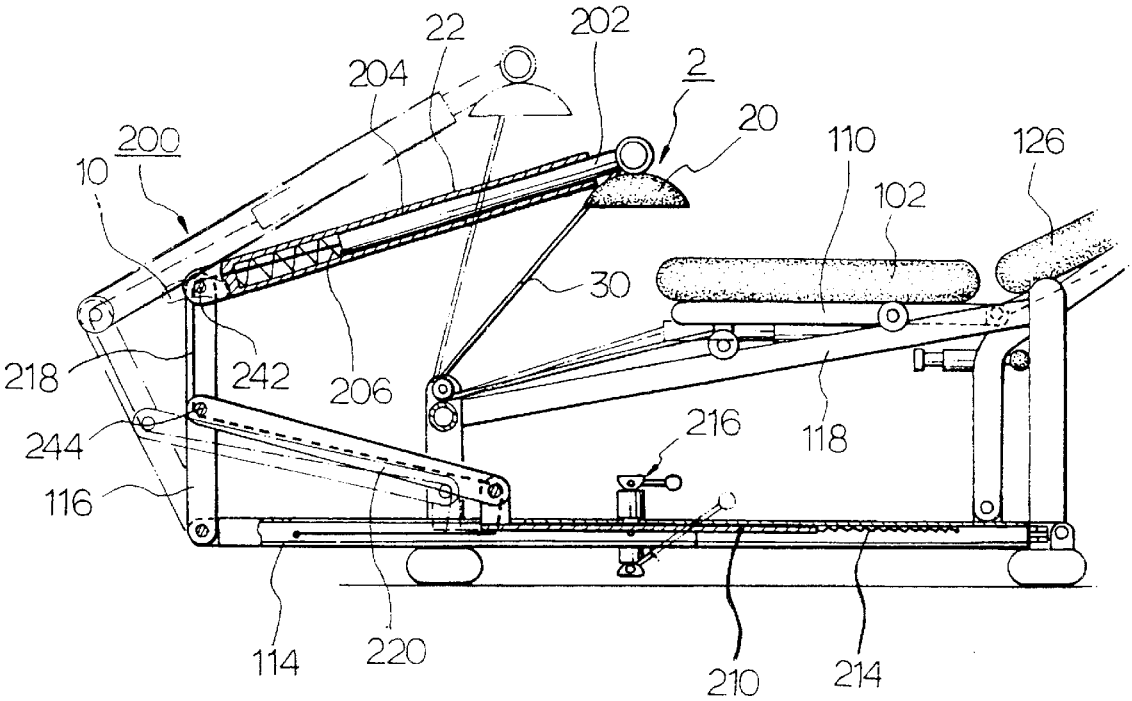
Figure 6:
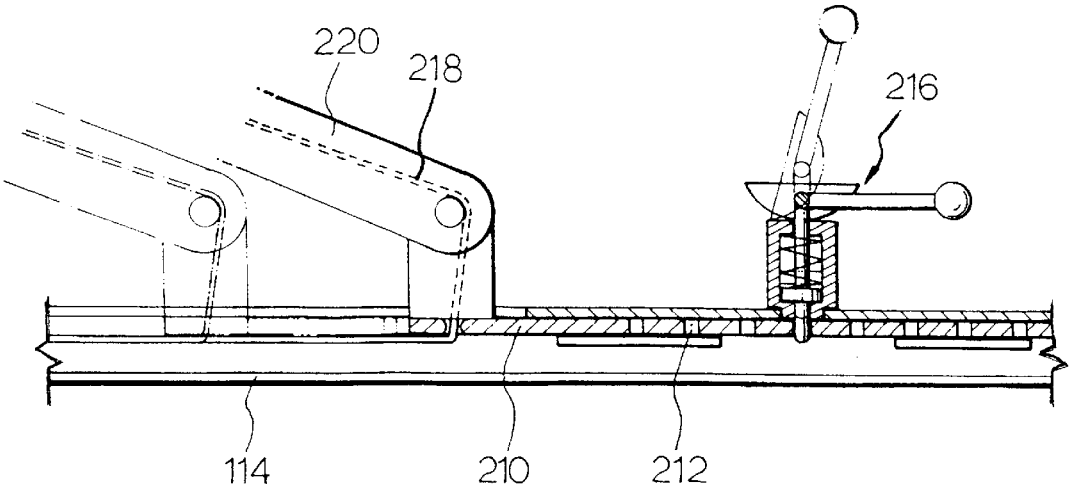

Now, the distance adjusting unit 200 will be described in conjunction with FIGS. 5 to 7. The distance adjusting unit 200 is adapted to adjust the distance between the foot holder 10 and knee holder 20 and between the knee holder 20 and seat plate 102 in accordance with the lengths between the foot and knee of the user and between the knee and wrist joint. The distance adjusting unit 200 includes a connecting member, such as a wire or rope, connected between the foot holder 10 and seat plate 102 and between the foot holder 10 and knee holder 20 via a movable member. By this configuration, the distance between the foot holder 10 and seat plate 102 and the distance between the foot holder 10 and knee holder 20 can vary in a certain ratio. A locking member is provided at a desired one of the operatively connected foot holders 10, seat plate 102, knee holders 20 and connecting member in order to lock those elements in a distance adjusted state.

For the length adjusting unit 200 in the illustrated case, the connecting bar 22 of the knee hold unit 2 attached with the knee holders 20 has a telescopic construction including an outer member 204 hingably mounted at the front end thereof to the lateral bar 26 connecting the vertical bars 116, and an inner member 202 slidably fitted at the front end thereof in the outer member 204 and attached with the knee holders 20 at the rear end thereof. In this case, the foot holders 10 are mounted to the front end of the outer member 204. In the outer member 204, a compression coil spring 206 is disposed between the front ends of the inner and outer members 202 and 204. A slider 210 is slidably mounted in the fixed base frame 114 while being always rearwardly urged by a tension spring 214 mounted to the rear end of the slider 210. The slider 210 has a plurality of longitudinally spaced fixing holes 212. A adjustment link 220 is linked at the front end thereof to a middle lateral bar 208 connected between the vertical bars 116 and at the rear end thereof to the slider 210, so that it is operatively connected to the slider 210. A control knob unit 216 is mounted on the fixed base frame 114 to control a fixed position of the slider 210. The control knob unit 216 has a locking pin engaged in a selected fixing hole 212 of the slider 210. A plurality of rollers 242, 244 and 246 are mounted to the hinges among the outer member 204 of the connecting bar 22, adjustment link 220, and slider 210, respectively. A wire 218 is connected between the front end of the inner member 202 of the connecting bar 22 and the front portion of the fixed base frame 114 in such a manner that it extends via the rollers 242, 244 and 246.

An assistant distance adjusting unit 230 may be provided to finely adjust the position of the seat plate 102. The assistant distance adjusting unit 230 includes a fixed slider box 222 fixedly mounted on the lower surface of the seat plate frame 110. A slider 224 is slidably received at its middle portion in the fixed slider box 222. The slider 224 is connected at the front end thereof to the rear end of the rope used as the load transmission unit 30 between the knee hold unit 2 and seat plate frame 110. The slider 224 has a plurality of fixing holes 226. A control knob unit 228 is mounted on the fixed slider box 222 to control a fixed position of the slider 224. The control knob unit 228 includes an outer casing 232 fixedly mounted at the upper end thereof to the lower surface of the fixed slider box 222, a locking pin 236 extending vertically through the fixed slider box 222 and engagable at the upper end thereof in a selected fixing hole 226 of the slider 224, a compression coil spring 234 arranged in the outer casing 232 and adapted to always urge the locking pin 236 in the upward direction. A handle 240 is hingably connected to the lower end of the locking pin 236. An actuating cam 238 is fixedly mounted to the end of the handle 240 connected to the locking pin 236 in such a manner that its cam surface is in contact with the lower end of the outer casing 232. As the handle 240 moves hingably, the actuating cam 238 rotates while being in contact with the lower end of the outer casing 232, thereby causing the locking pin 236 to move vertically. Thus, the locking pin 236 is locked in a selected fixing hole 226 of the slider 224 or released from the fixing hole. The control knob unit 216 of the distance adjusting unit 200 and other control knob units 352, 390, 69, 460 and 500, which will be described hereinafter, have the same construction as the control knob unit 228.

Where it is desired to adjust the distance between the foot holder 10 and knee holder 20, the control knob unit 216 first releases the locked state of the slider 210. In this state, the outer member 204 of the connecting bar 22 is extracted from the inner member 202 by virtue of the compression coil spring 206. At the same time, the slider 210 and adjustment link 220 move forwardly as the vertical bars 116 pivot forwardly about its lower hinge. The movements of these elements are slowly carried out because those elements are connected to the inner member 202 of the connecting bar 22 by the wire 218. When a desired distance is obtained between the foot holder 10 and knee holder 20, the control knob unit 216 operates to lock the slider 210 at a corresponding position. Thus, the distance between the foot holder 10 and knee holder 20 can be adjusted. In this case, it is required that the compression coil spring 206 have a resilience larger than that of the tension spring 214 in order to obtain a smooth operation for the distance adjustment.

The movement of the slider 2,24 results in the movement of the outer member 204. When the outer member 204 moves forwardly, the lateral bar 26 attached with the foot holders 10 moves downwardly and forwardly with respect to the knee holders 20. Accordingly, it is possible to adjust the distance between the foot holder 10 and knee holder 20. In this case, the knee holders 20 also moves forwardly and upwardly. Accordingly, it is also possible to adjust the knee holder 20 and seat plate 102.

Where it is desired to reduce the distance between the foot holder 10 and knee holder 20, the control knob unit 216 first releases the locked state of the slider 210. In this state, the user depresses the knee holders 20, thereby causing the outer member 204 to be retracted into the inner member 202. As the outer member 204 retracts into the inner member 202, the slider 210 moves rearwardly by virtue of the resilience of the tension spring 214. When a desired distance is obtained between the foot holder 10 and knee holder 20, the control knob unit 216 operates to lock the slider 210 at a corresponding position. Thus, the distance between the foot holder 10 and knee holder 20 can be adjusted.

Figure 7:
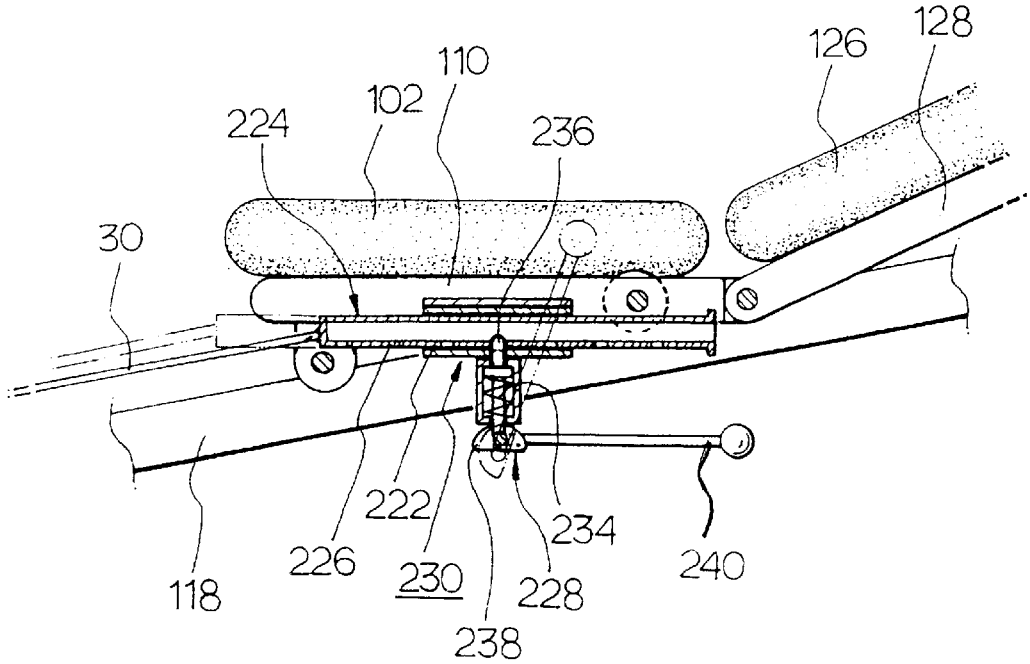

The distance between the knee holder 20 and seat plate 102 can be finely adjusted by operating the assistant distance adjusting unit 230 shown in FIG. 7. This can be achieved by moving the slider 224 connected to the rope, namely, the load transmission unit 30, after releasing the locked state of the slider 224 by the knob control unit 228, and then locking the slider 224 at an adjusted position by the knob control unit 228.

Figure 8:
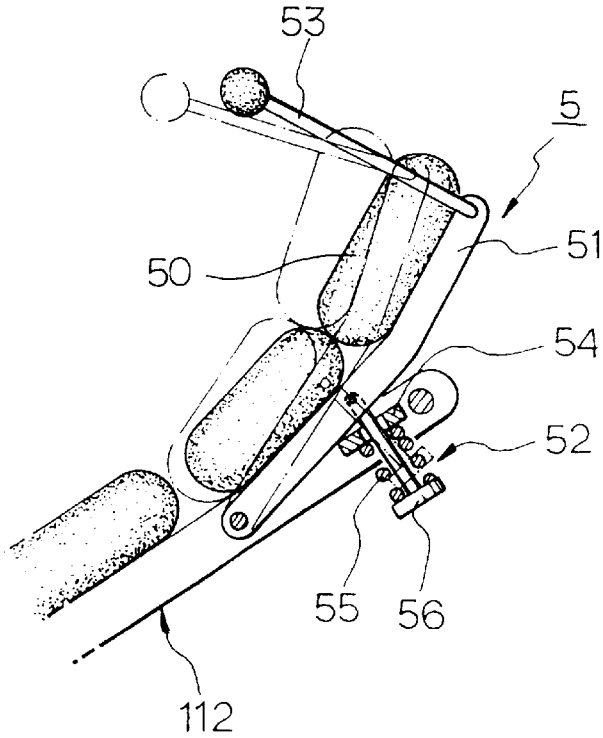
FIG. 8 is a view showing the operation of an upper body flection/extension exercise unit included in the device of FIG. 1.
Figure 9:
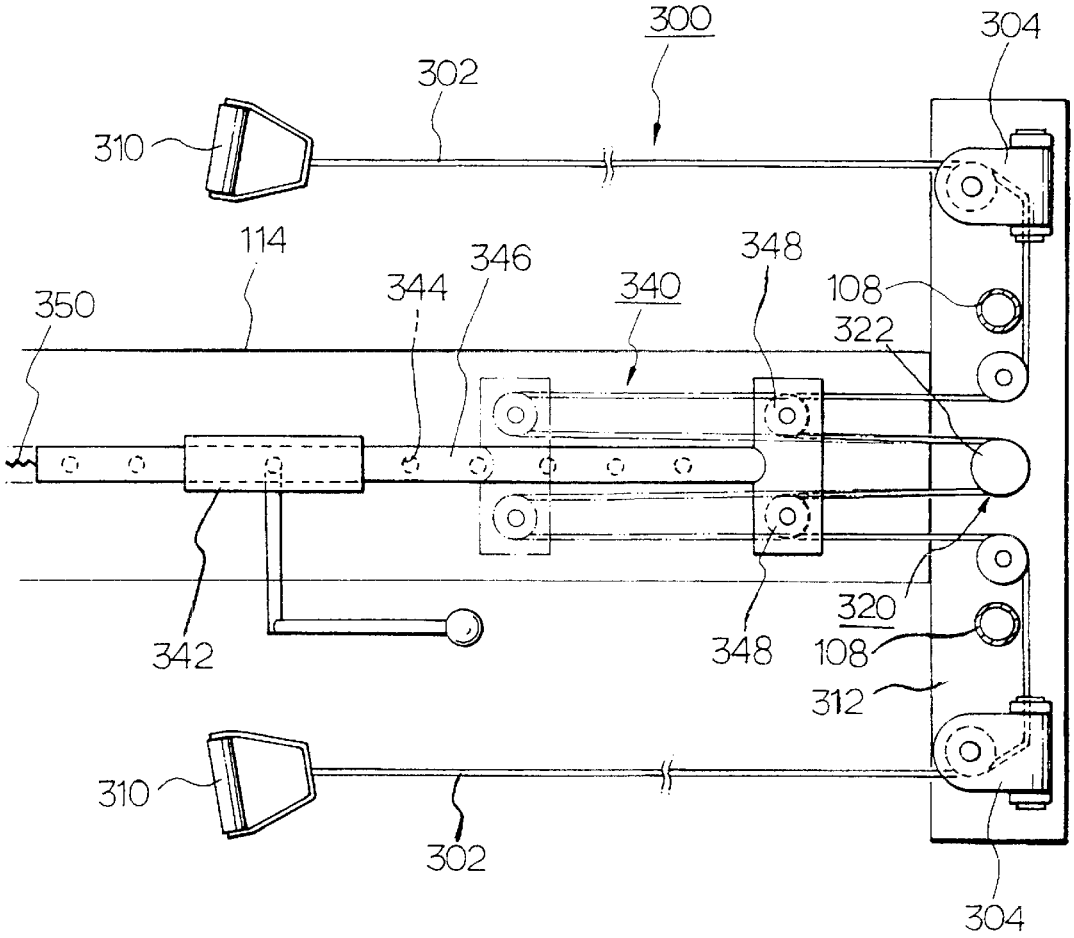
Figure 10:
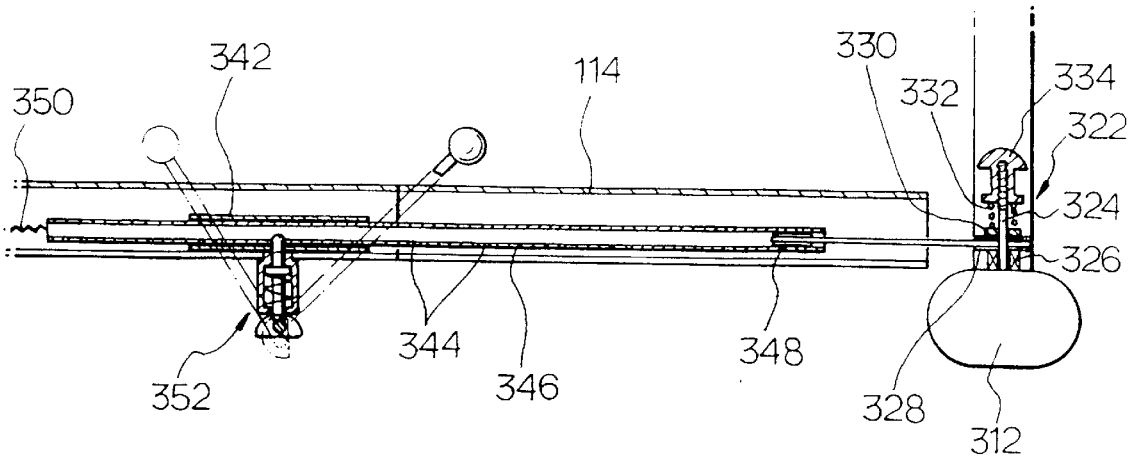

Now, the upper body flection/extension exercise unit 5 will be described in conjunction with FIG. 8. As shown in FIG. 8, the upper body flection/extension exercise unit 5 includes an upper frame 51 hingably mounted at the lower end thereof to the upper end of the back plate frame 112. The upper frame 51 is attached with an upper plate 50 serving as a pillow or assistant back plate. The upper body flection/extension exercise unit 5 also includes an exercise load unit 52 arranged at the middle portion of the upper frame 51 and connected between the upper frame 51 and back plate frame 112. If necessary, handles 53 may be provided at the upper end of the upper frame 51. As shown in FIG. 8, the exercise load unit 52 includes a fixed member 54 fixedly mounted to the upper end of the back plate frame 112, a movable member 56 fixedly mounted at one end thereof to the middle portion of the upper frame 51, the movable member 56 extending through the fixed member 54, and a spring 55 arranged between the fixed member 54 and the other end of the movable member 56. Although not shown, the exercise load unit 52 may comprise conventional load units such as an elastic member, weight or hydraulic or pneumatic cylinder. Where an exercise is carried out using the upper body flection/extension exercise unit 5, the user moves forwardly the upper portion of his upper body about the hinge of the upper frame 51 and then returns the moved upper portion of his upper body to the original position while holding his head on the upper plate 50 and grasping the handles 53 by his hands. As the user performs repeatedly the above movements, a repeated flection and extension exercise is carried out. By this exercise, the epigastric muscle of the user can be strengthened.

The repeated extension/retraction exercise unit 300 shown in FIGS. 1, 2 and 5 and FIGS. 9 to 14 will now be described.

The repeated extension/retraction exercise unit 300 is configured to be used in combination with the above-mentioned exercise units or to be used independently of the exercise units. This exercise unit 300 includes a rope 302 serving as a load transmission unit. The rope 302 extends via a plurality of direction change rollers 304 and has grips 310 having the shape of a foot holder at opposite ends thereof, respectively. When the rope 302 is drawn at one end thereof by drawing the associated grip 310, its length at the other end thereof is reduced. When the grip 310 at the other end of the rope is drawn, the rope 302 decreases in length at the other end thereof increases while increasing in length at one end thereof. Thus, repeated extension and retraction of the rope 302 is carried out while optionally adjusting the exercise load at each end of the rope 302.

Figure 11:
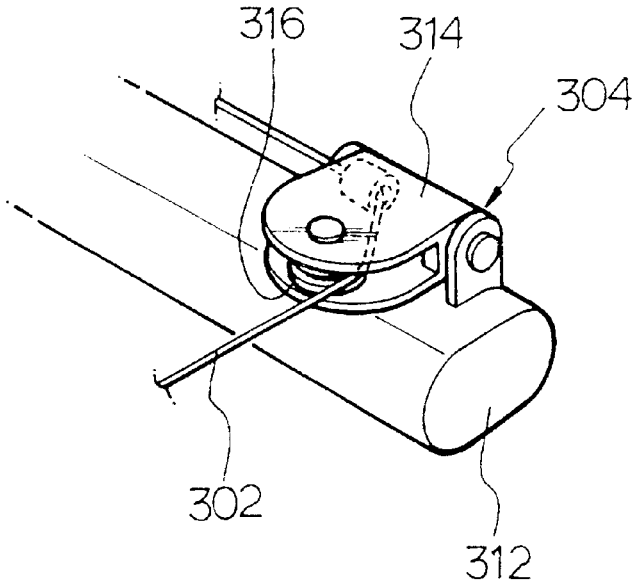
Figure 12:
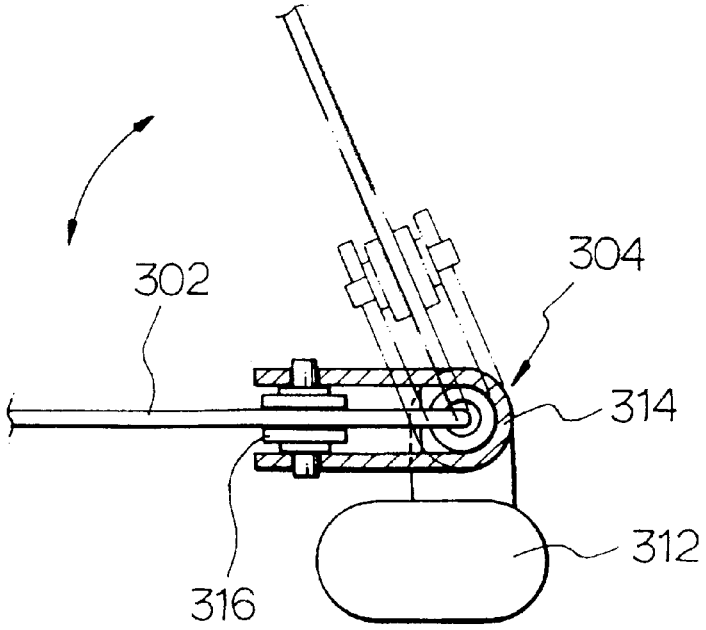

In the case illustrated in FIGS. 9 to 12, the rope 302 extends via a pair of direction change rollers 304 mounted to a fixed frame 312 arranged rearwardly of the fixed base frame 114. The fixed frame 312 supports the vertical legs 108. The repeated extension/retraction exercise unit 300 also includes a rope length adjusting unit 340 and a load adjusting unit 320 both connected to the rope 302. As shown in FIGS. 11 and 12, each direction change roller 304 includes a roller casing 314 vertically hingably mounted on the fixed frame 312, and a roller body 316 horizontally rotatably mounted in the roller casing 314.

A load adjusting roller 322, which constitutes the load adjusting unit 320, is mounted on a central shaft 324 fixed to the central portion of the fixed frame 312. The load adjusting roller 322 includes a bearing 326, a roller body 328, a brake disc 330 and a spring 332 fitted around the central shaft 324 in this order. A adjustment cap nut 334 is threadedly coupled to the upper end of the central shaft 324 in order to adjust the urging force of the spring 332 against the brake disc 330. Accordingly, it is possible to adjust the exercise load applied to the roller body 328 in accordance with the coupled position of the cap nut 334.

The rope length adjusting unit 340 includes a guider 342 fixedly mounted in the fixed base frame 114, and a T-shaped slider 346 slidably fitted at its middle portion in the guider 342 and provided with a plurality of fixing holes 344. A pair of guide rollers 348 are mounted on the rear end of the slider 346. A tension spring 350 is mounted to the front end of the slider 346. The rope length adjusting unit 340 also includes a control knob unit 352 mounted to the lower surface of the fixed base frame 114 selectively engaged in a desired fixing hole 344 of the slider 346. When the user pulls both the grips 310 in a lock releasing state of the control knob unit 352, the slider 346 moves rearwardly, namely, toward the fixed frame 312, thereby causing the rope 302 to increase in length at each end thereof. On the contrary, when the pulling force applied to the grips 310 is released, the slider 346 moves forwardly by virtue of the resilience of the tension spring 350, thereby causing the rope 302 to decrease in length at each end thereof. Accordingly, it is possible to adjust the rope 302 in length at each end thereof by locking the slider 346 at a desired position by the control knob unit 352.

Figure 13:
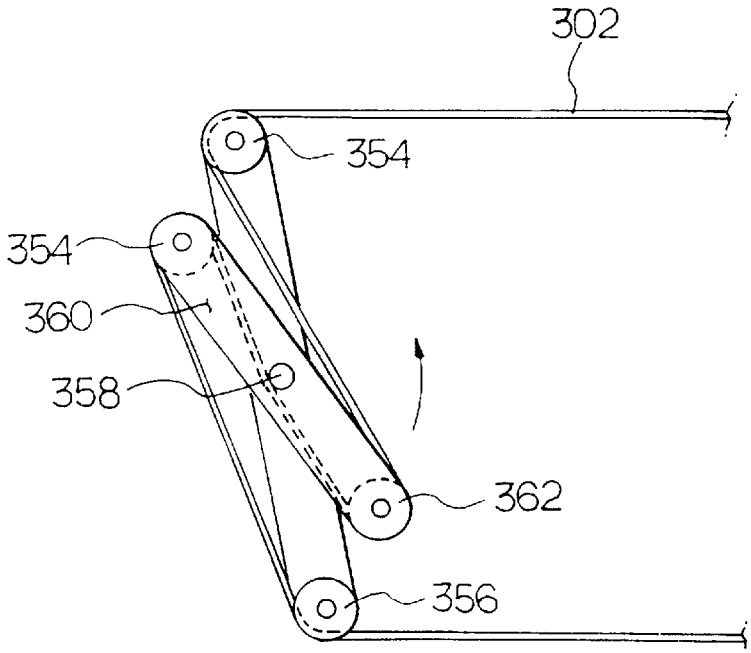
Figure 14:
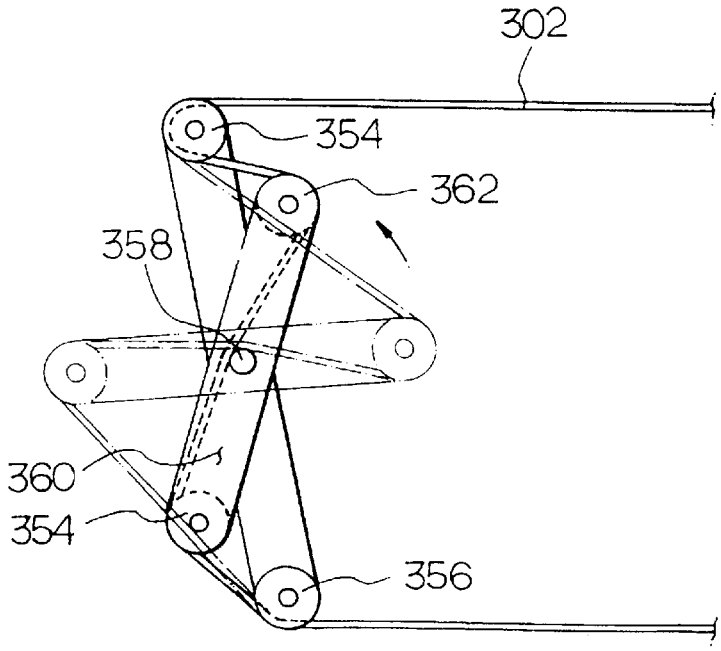

FIGS. 13 and 14 illustrate a modified configuration of the rope length adjusting unit 340, respectively. Similarly to the above mentioned rope length adjusting unit 340, this rope length adjusting unit is operatively connected to the rope 302. As shown in FIGS. 13 and 14, the rope length adjusting unit includes a pair of spaced fixed rollers 354 and 356 mounted on the fixed base frame 114, a roller mounting bar 360 pivotally mounted on a central shaft 358 fixed to the fixed base frame 114, and a pair of movable rollers 362 and 364 respectively mounted on opposite ends of the roller mounting bar 360. The rope 302 extends via the rollers 354, 362, 364 and 356 in this order. The roller mounting bar 360 is configured to be locked at a desired pivoted position. Accordingly, it is possible to adjust the rope in length at each end thereof in accordance with the pivoted position of the roller mounting bar 360.

Figure 15:
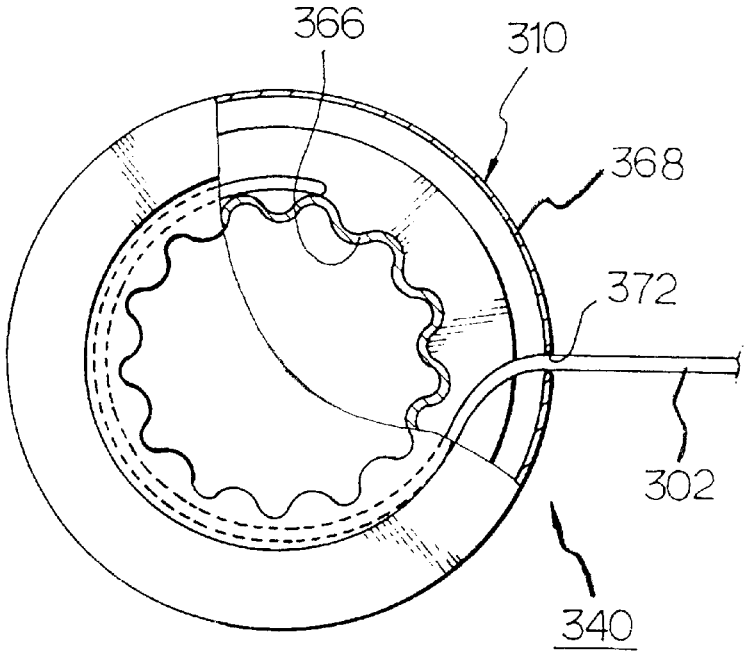
Figure 16:
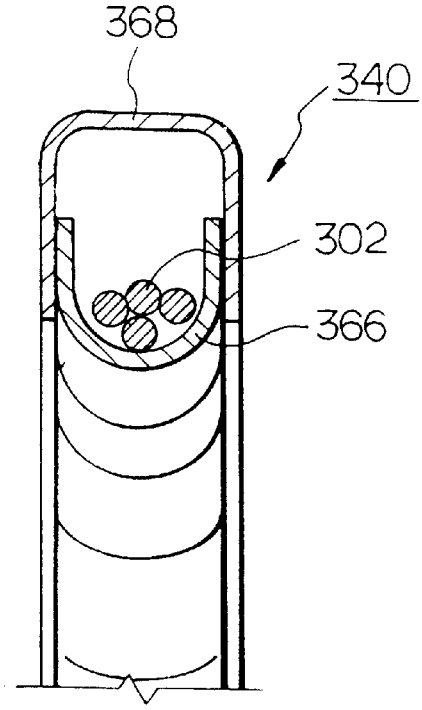

FIGS. 15 and 16 illustrate another modified configuration of the rope length adjusting unit 340, respectively. Similarly to the above mentioned rope length adjusting unit 340, this rope length adjusting unit is operatively connected to the rope 302, In the case illustrated in FIGS. 15 and 16, for the rope length adjusting unit, each grip has a construction including an inner grip member 366 and an outer grip member 368 both slidably coupled to each other in such a manner that they rotate with respect to each other. A rope receiving chamber 370 is defined between the inner and outer grip members 366 and 368, The outer grip member 368 has a hole 372 through which the rope 302 extends. To the inner grip member 366, an associated end of the rope 302 is fixedly mounted. When the user rotates the inner grip member 366 in one direction, namely, the clockwise direction in FIG. 15, while grasping the outer grip member 366, the rope 302 comes into the rope receiving chamber 370 via the hole 372 while being wound around the inner grip member 366. On the contrary, when the user pulls outwardly the rope 302 while grasping the outer grip member 368, the rope 302 is unwound from the inner grip member 366. Thus, it is possible to adjust the rope in length at each end thereof. In this case, the user performs an exercise while grasping both the inner and outer grip members 366 and 368 of each grip 310 in order to prevent rotations of those members, thereby preventing the rope 302 from being unwound.

Figure 17:
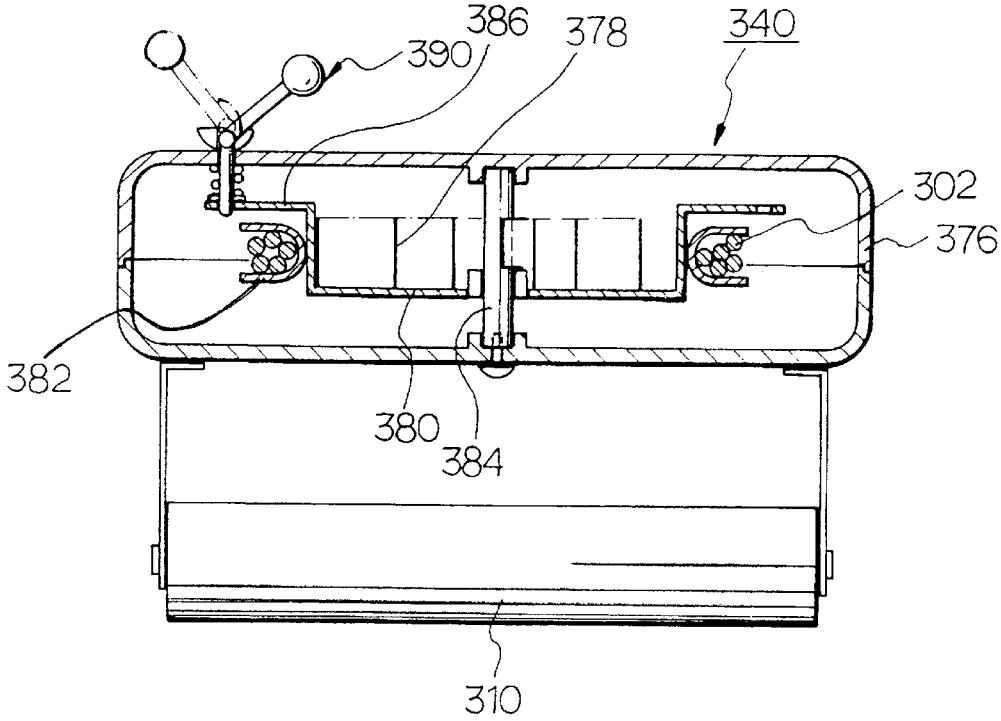
Figure 18:
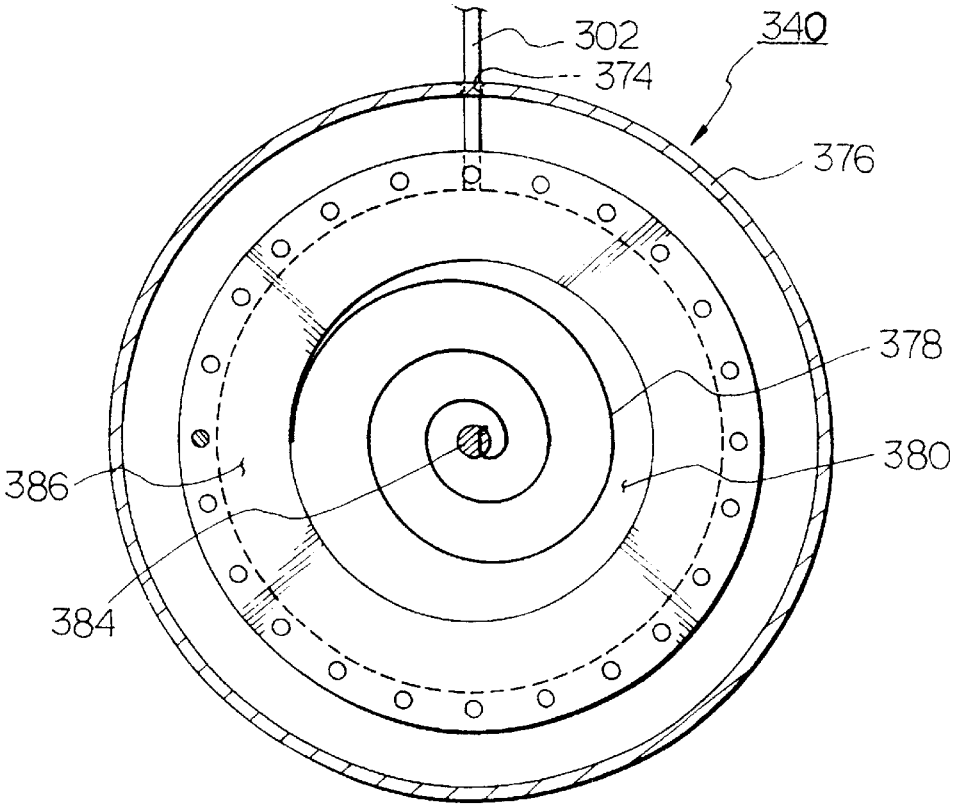
Figure 19:
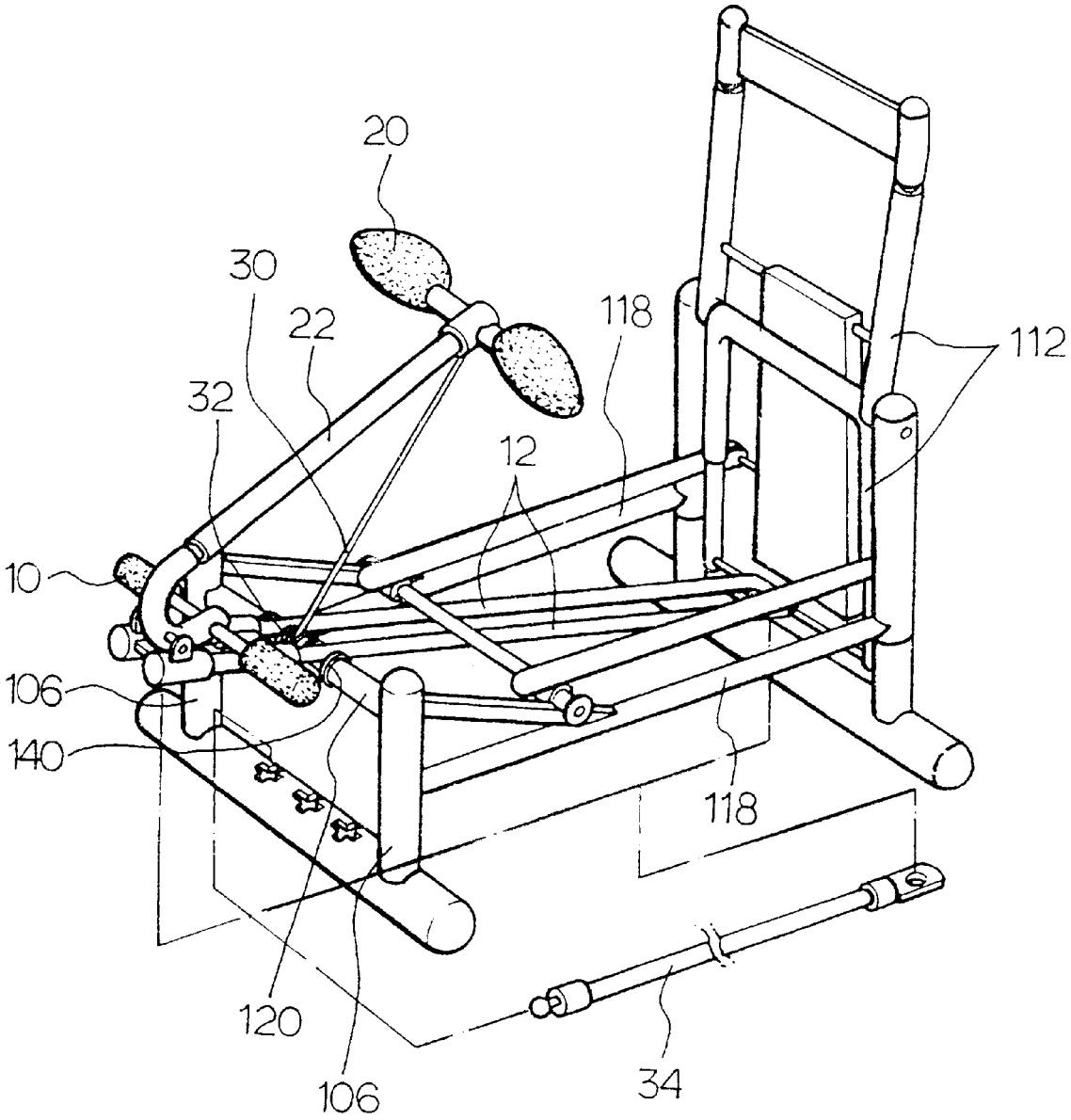

FIGS. 17 and 18 illustrate another modified configuration of the rope length adjusting unit 340, respectively. In the case illustrated in FIGS. 15 and 16, the rope length adjusting unit includes a casing 376 to which each grip 310 is fixed. The casing 376 has a hole 374 through which the rope 302 extends. In the casing 376, a drum 380 is rotatably mounted on a central shaft 384 fixed to the central portion of the outer casing 376. A spiral spring is arranged in the drum 380 in such a manner that both ends thereof are connected to the central shaft 384 and drum 380. The drum 380 has a flange 386 provided with a plurality of peripherally spaced fixing holes 388. A rope holer 382 is fixedly fitted around the drum 380 in order to wind the rope 302 thereon. To the rope holder 382, an associated end of the rope 302 is fixed. A control knob unit 390 is fixedly mounted on the casing 376 in such a manner that it engages in a selected fixing hole 388 of the rope holder 382. Where it is desired to adjust the length of the rope 302, the locking state of the control knob unit 390 is first released. In this state, the user pulls or releases the rope 302, thereby causing the rope 302 to be unwound from the rope holder 382 or to be wound on the rope holder 382 by virtue of the resilience of the spiral spring 378. Accordingly, it is possible to adjust the length of the rope 302 by locking the rope holder 382 at a desired position by the control knob unit 390.

The configurations respectively illustrated in FIGS. 15 and 16 and FIGS. 17 and 18 may be replaced for the rope length adjusting unit 340 illustrated in FIGS. 9 and 10 or FIGS. 13 and 14. Also, they can be replaced for or combined with grips illustrated in FIGS. 24, 29 and 34, as will be described hereinafter.

Although the repeated extension/retraction exercise unit 300 is arranged beneath the seat unit 100 in the illustrated case, it may be arranged at other appropriate positions. For example, this unit 300 may be arranged rearwardly of the back plate frame 112. Using the repeated extension/retraction exercise unit 300, it is possible to carry out a variety of exercises about the middle portion of the body such as exercises for latissimus dorsi muscle and dorsal muscle using both arms and exercises for the lower body using both feet.

FIGS. 19 to 23 illustrate a modified configuration of the exercise device in accordance with the present invention. In this embodiment, the leg support unit 1 is configured to be movable during an exercise. The movable frames of the seat unit 100 including the seat plate 102 and back plates 104 and 126 are also configured to be movable. In order to provide such configurations, a knee holder moving unit 6 is provided in this embodiment.

In this case, the leg support unit 1 includes a leg support bar 12 hingably mounted at the rear end thereof to the seat unit 100 and slidably supported at the front portion thereof by a roller 140 mounted on the lateral bar 120 connected between the front vertical legs 106. A connecting bar 22 is hingably connected at the lower end thereof to the front end of the leg support bar 12. A pair of foot holders 10 are fixed to the lower end of the connecting bar 22. The seat unit 100 includes a pair of laterally spaced longitudinal bars 118 each fixedly mounted at both ends thereof to respective upper ends of the associated front and rear vertical legs 106 and 108. A pair of inclined support bars 146 are fixedly connected at respective rear ends thereof to the middle portions of the longitudinal bars 118. The front end of each inclined support bar 146 is fixedly connected to the upper end of the associated vertical legs 106. The seat unit 100 also includes a back plate frame 112 hingably mounted at the middle portion thereof to a hinge connected between the upper ends of the rear vertical legs 108 and hingably connected at the front or lower end thereof to the rear end of the leg support bar 12 by means of a hinge 142. A pair of slide support bar 148 are also provided. Each slide support bar 148 is hingably mounted at the rear end thereof to a hinge connected between the middle portions of the rear vertical legs 108. Each slide support bar 148 is slidably supported at the front end thereof on the associated inclined support bar 146 by a slide roller 144 which is mounted on the lower surface of the slide support bar 148 at the front end of the slide support bar 148. The seat unit 100 further includes an assistant back plate frame 128 hingably mounted at the rear or upper end thereof to the middle portion of the back plate frame 112 above the rear vertical legs 108, and a seat plate frame 110 hingably mounted at the rear end thereof to the front or lower end of the assistant back plate frame 128 and provided at the front and rear portions thereof with front and rear rollers 130 and 132 adapted to slide on the slide support bars 148.

Figure 20:
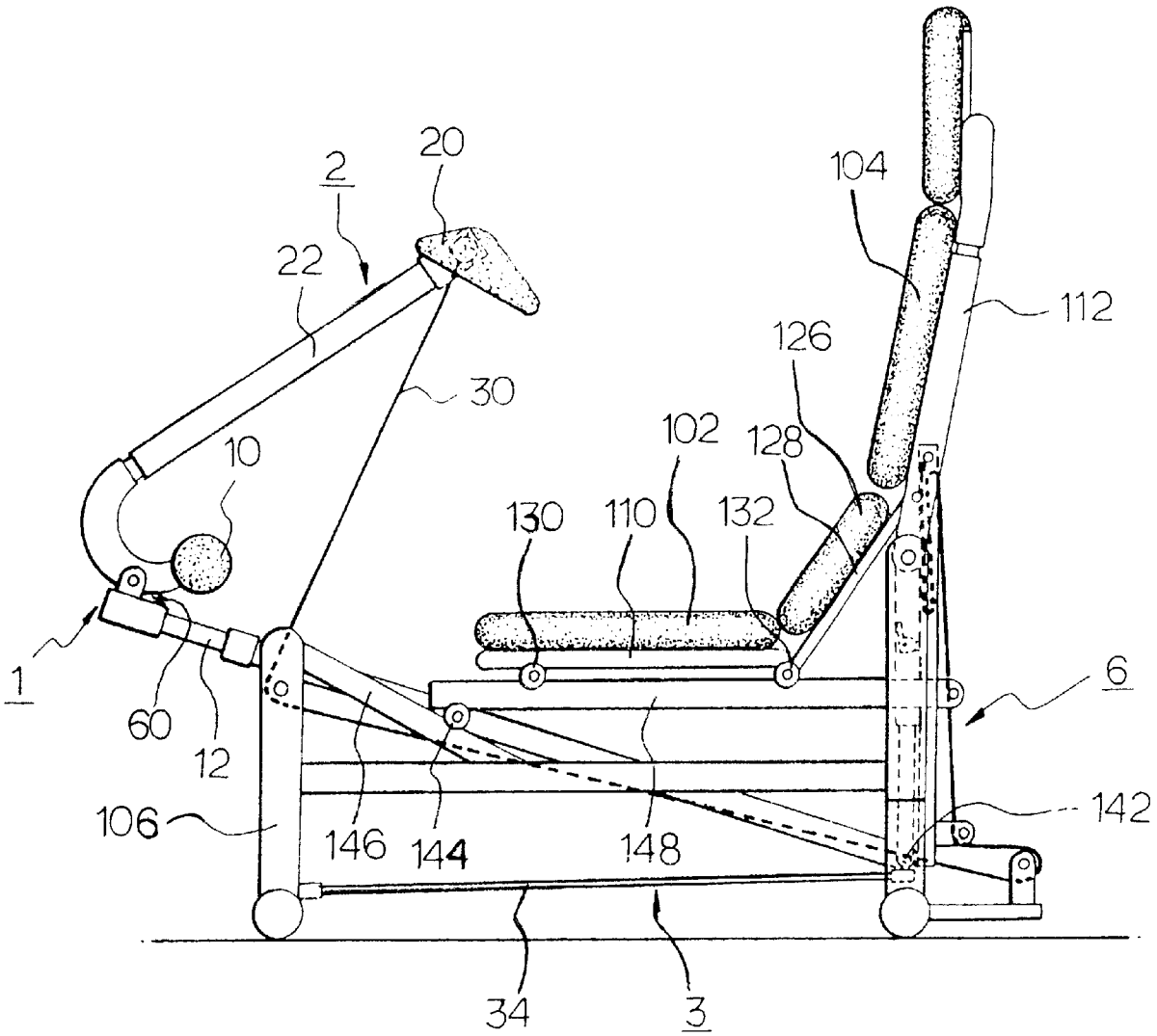
Figure 21:
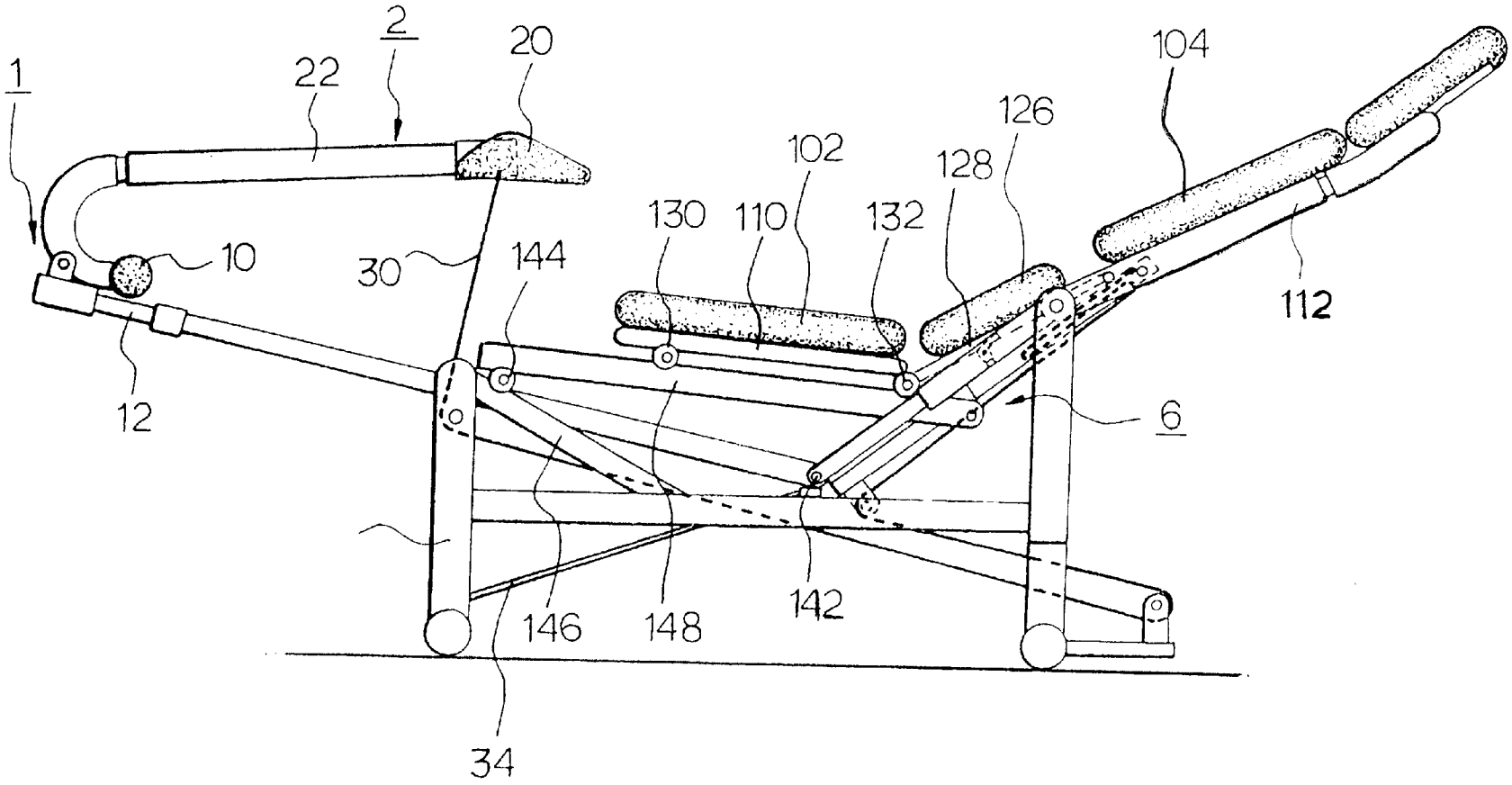

The knee hold unit 2 includes the connecting bar 22 hingably mounted at the front or lower end thereof to the front end of the leg support bar 12. A pair of knee holders 20 are fixedly mounted to the rear or upper end of the connecting bar 22. As shown in FIGS. 20 and 21, the exercise load unit 3 is connected to the knee hold unit 2 by a rope type load transmission unit 30. The load transmission unit 30 includes an idle roller 32 mounted to the lateral bar 120 connecting the front vertical legs 106, and a rope connected at both ends respectively to the knee hold unit 2 and seat unit 100 while being wound on the idle roller 32. When the user moves upwardly the knee holders 20 about the hinge at the front end of the connecting bar 22 by his knees, the weight of the user applied to the seat unit 100 is transmitted to the knee hold unit 2 via the rope and idle roller 32 of the load transmission unit 30 while the seat plate 102 and back plate 104 move forwardly. Accordingly, the weight of the user serves as an exercise load for the knee hold unit 2. A separate load unit 34, which includes a plurality of elastic members, may be connected between the lower end of the back plate frame 112 or the rear end of the leg support bar 12 and a lower fixed bar supporting the front vertical legs 106, thereby generating an effect of exercise load for the knee hold unit 2.

Figure 44:
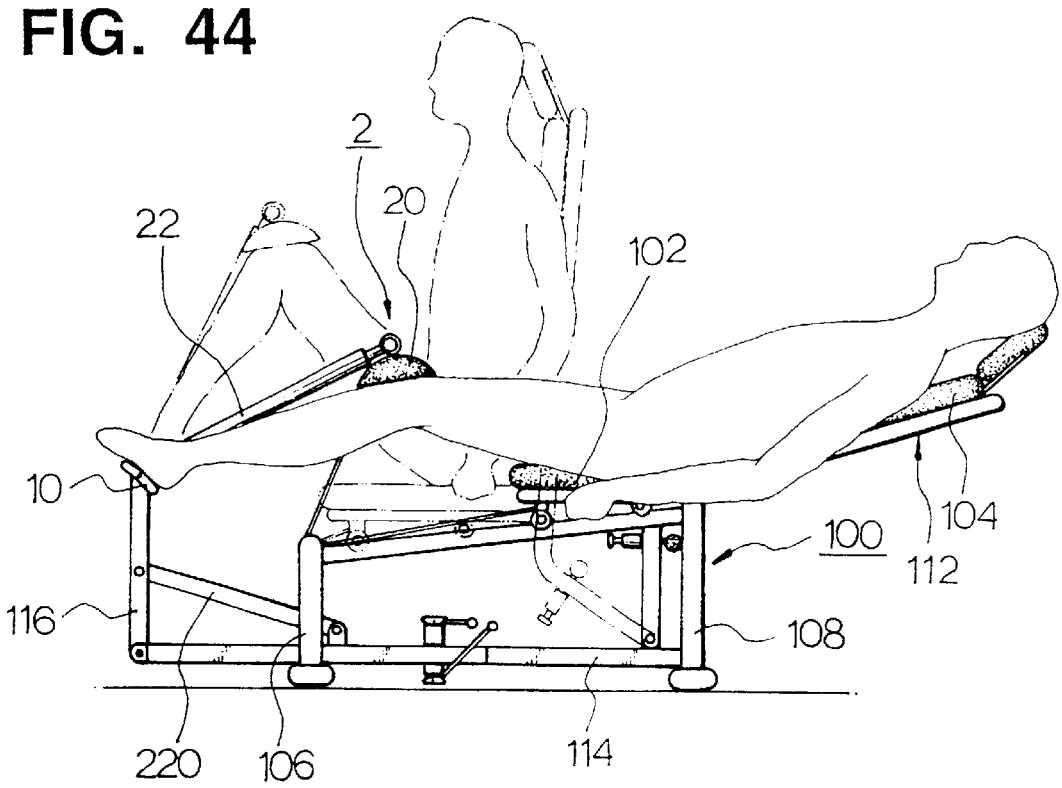
FIG. 44 is a view showing the operation of the exercise device of FIGS. 1 and 2.

The number and shape of elastic members of the load unit 34 may be appropriately selected, as described in conjunction with the embodiment illustrated in FIGS. 1 to 14. The position of the load unit 34 may also be optionally determined.

Where it is desired to carry out an exercise using the exercise device illustrated in FIGS. 1 to 3 or FIGS. 19 to 21, the user first lays his feet on the foot holders 10 at a sitting or lying status while holding his knees on the knee holders 20, respectively, as shown in FIG. 44. Under this condition, the user moves the knee holders 20 upwardly and downwardly about the hinge at the front end of the connecting bar 22 by his knees, thereby carrying out an exercise. At the same time, the seat plate 102 and back plate 104 of the seat unit 100 move forwardly and rearwardly while being lowered and lifted by the movements of the knee holders 20. Such movements of the seat unit 100 moves the upper and lower bodies of the user. Accordingly, it is possible to achieve an extension and flection exercise about the wrist joints.

Even in the case wherein the exercise device includes no leg support unit having foot holders while including a seat unit having a fixed seat or back plate and a movable knee hold unit provided with knee holders and connected with an exercise load unit, it is possible to obtain a flection and extension exercise about the wrist joints only using the knee hold unit.

Now, the knee holder moving unit 6, which is applied to such a modified embodiment, will be described.

Figure 22:
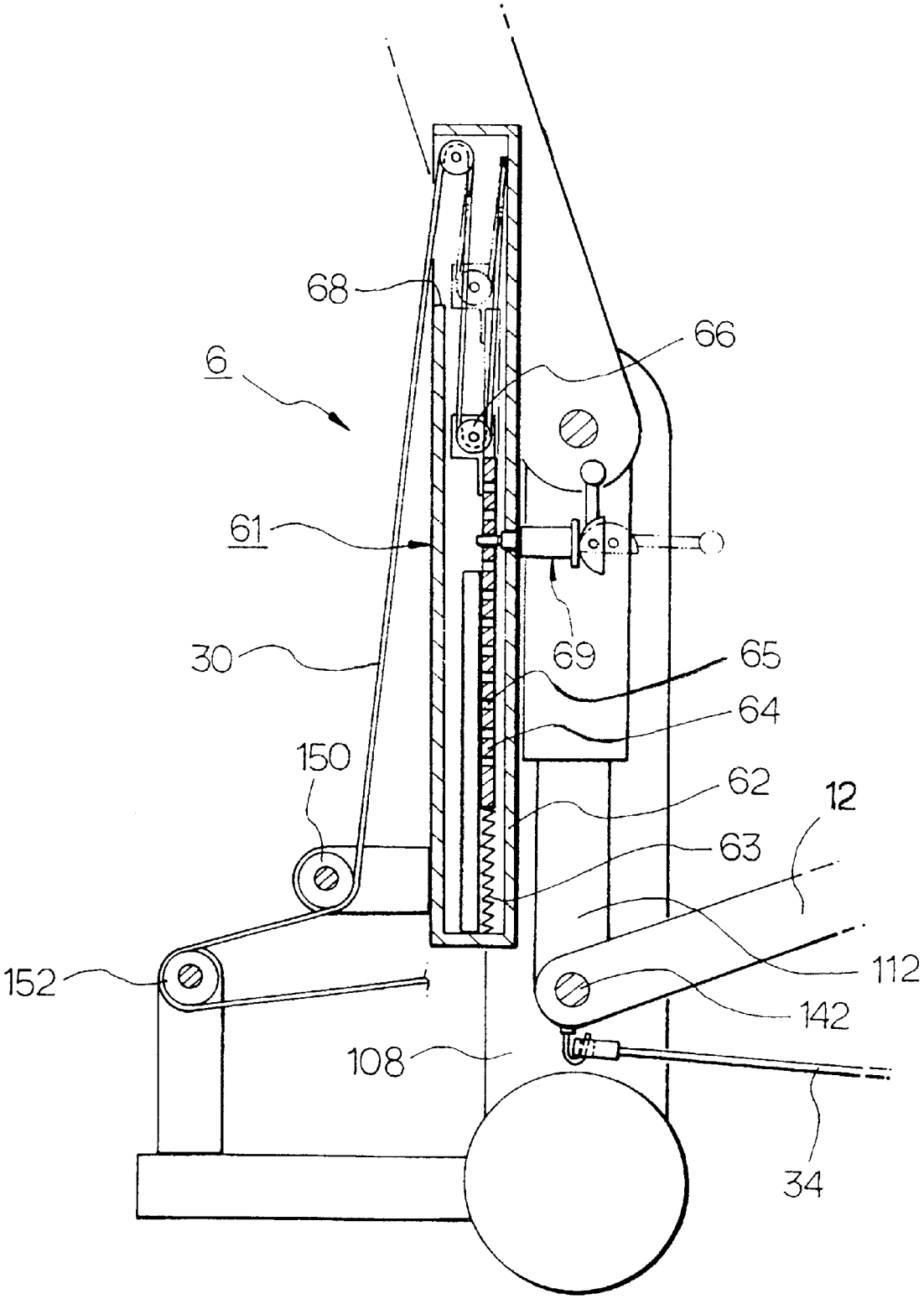
Figure 23:
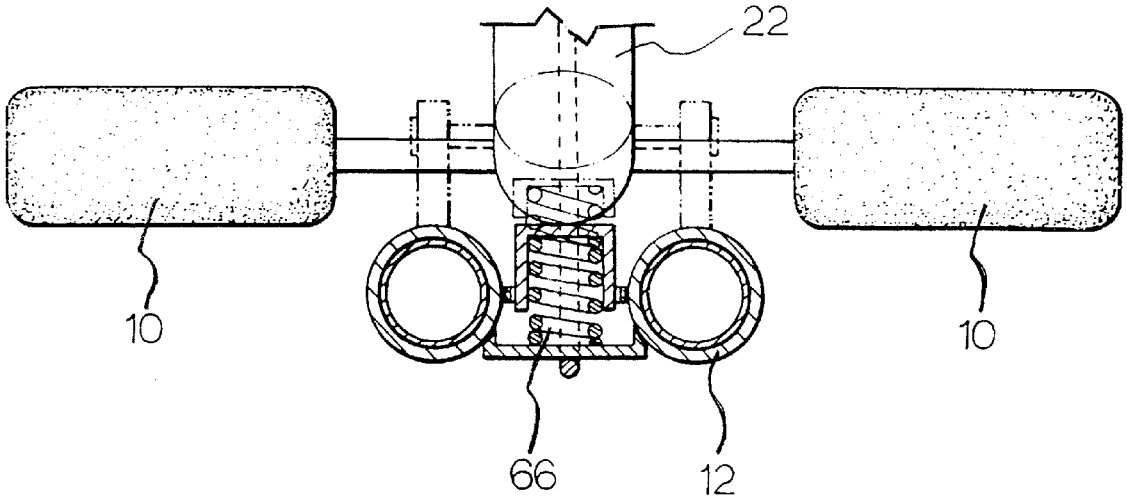

The knee holders 20 may interfere with the user who sits down on the seat plate 120 to carry out an exercise or rises up from the seat plate 120 after the exercise. The modified embodiment is adapted to temporarily move the seat plate 102, thereby obtaining a space allowing the user to sit down on the seat plate 102 or to rise up from the seat plate 120 without any interference. This can be achieved using a variety of configurations. For example, a configuration may be used in which the rope type load transmission unit 30 increases and decreases in length, thereby moving the knee holders 20 upwardly and downwardly. In accordance with another configuration, the connection between the load transmission unit 30 and knee holders 20 is temporarily released to allow the knee holders 20 to move upwardly. The knee holders 20 are connected again to the load transmission unit 30 upon carrying out an exercise. Another configuration may be used in which the knee holders 20 is laterally rotatable or movable. In the case of FIGS. 20 and 23, a compression coil spring 60 is arranged between the connecting bar 22 and leg support bar 12 to always urge the knee holders 20 toward their lifted position. In this case, the load transmission unit 30 may be configured to be selectively separable from the knee holders 20 without having no configuration for adjusting the length thereof. In the case of FIG. 22, a length adjusting unit 61 adapted to adjust the load transmission unit 30 is used. The length adjusting unit 61 adjusts the length of the load transmission unit 30 under the condition in which the knee holders 20 are forcibly lowered, thereby varying the inclined angle of the back plate 104.

As shown in FIG. 22, the length adjusting unit 61 includes a fixed slider box 62 fixedly mounted on the rear surface of the back plate frame 112. A slider 64 is received in the fixed slider box 62 in such a manner that it slides upwardly and downwardly. A tension spring 63 is connected between the lower ends of the slider 64 and slider box 62 so as to always urge the slider 64 upwardly. The slider 64 has a plurality of vertically spaced fixing holes 65. An idle roller 66 is mounted to the upper portion of the slider 64. In the fixed slider box 62, another idle roller 67 is mounted to the upper end of the fixed slider box 62. An opening is also provided at the upper portion of the fixed slider box 62 near the idle roller 67. A control knob unit 69 is mounted on the outer surface of the fixed slider box 62 to control a fixed position of the slider 64. A pair of idle rollers 150 and 152 are also arranged at the lower portion of the back plate frame 112 and rearwardly of the rear vertical legs 108, respectively. A rope, which constitutes the load transmission unit 30, is connected between the knee holder 20 and the upper end of the fixed slider box 62 while extending via the idle roller 32 arranged between the front vertical legs 106, and the idle rollers 152, 150, 67 and 66, in this order. When the control knob unit 69 releases its locking state shown in FIG. 22, the slider 64 moves upwardly, thereby causing the rope of the load transmission unit 30 to be released. As a result, the knee holders 20 moves upwardly by virtue of the compression coil spring 60. Accordingly, the user can easily sit down on the seat plate 102. When the user, who sits down on the seat plate 102, forcibly lowers the knee holders 20 to a desired position by his hands, the rope of the load transmission unit 30 is released again, thereby causing the slider 64 to move downwardly by virtue of the resilience of the tension coil spring 63. When the slider 64 reaches a desired position, the user locks the slider 64 by the control knob unit 69. Thus, the preparation for an exercise is easily achieved.

Now, a foot holder pressure adjusting unit, which is applied to the exercise device in accordance with the present invention, will be described in conjunction with FIG. 24.

Figure 24:
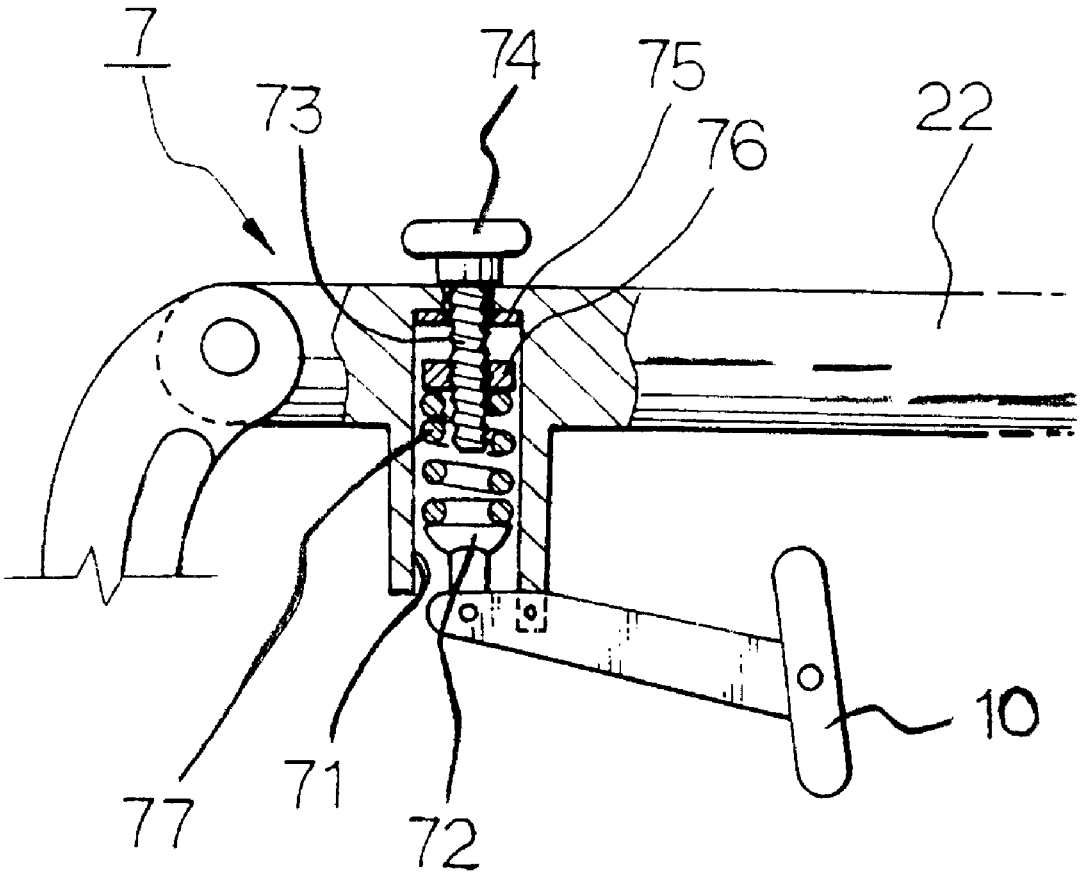
FIG. 24 is a partially sectioned view showing the construction of a foot holder pressure adjusting unit included in the exercise device of this invention.

Although the foot holders 10 can be directly mounted to the connecting bar 22 as mentioned above, it may also be mounted to the connecting bar 22 via a foot holder pressure adjusting unit 7 shown in FIG. 24. As shown in FIG. 24, the foot holder pressure adjusting unit 7 includes a square installation space 71 provided at a portion of the connecting bar 22 near the front end of the connecting bar 22. To define the square installation space 71, an extension extends from the connecting bar 22 perpendicularly to the longitudinal direction of the connecting bar 22. A foot holder 10 is hingably mounted at its middle portion to the extension of the connecting bar 22. The foot holder 10 is provided at the front end thereof with a lower spring seat 72 disposed in the installation space 71. A control knob 74 is threadedly coupled to the connecting bar 22 at a position opposite to the extension. The control knob 74 has a threaded rod 73 received in the installation space 71. In the installation space 71, a snap ring 75 and an upper spring seat 76 are threadedly coupled to the threaded rod 73 of the control knob 74. A compression coil spring 77 is also disposed in the installation space 71 between the lower and upper spring seats 72 and 76. As the control knob 74 rotates, the upper spring seat 76 moves vertically along the threaded rod 73. Accordingly, the distance between the lower and upper spring seats 72 and 76 is adjusted, thereby adjusting the resilience of the compression coil spring 77 applied to the foot holder 10.

Where the user applies an upward force to the knee holders 20 while laying his feet on the foot holders 10 to which the foot holder pressure adjusting unit 7 is applied, a downward force is also applied to the foot holders 10. The downward force applied to the foot holders 10 causes the foot holders 10 to move downwardly without any considerable resistance by virtue of the foot holder pressure adjusting unit 7. Accordingly, it is possible to achieve an exercise using only the knees. Where the user lays only his feet on the foot holders 10 and repeatedly applies a downward force to the foot holders 10 while pivoting his feet about his ankles, an exercise for the crook muscle can be achieved. For such exercises, other configurations may be appropriately used in accordance with the present invention.

Now, a shift preventing unit, which is applied to the exercise device in accordance with the present invention, will be described in conjunction with FIGS. 25 to 27.

Figure 25:
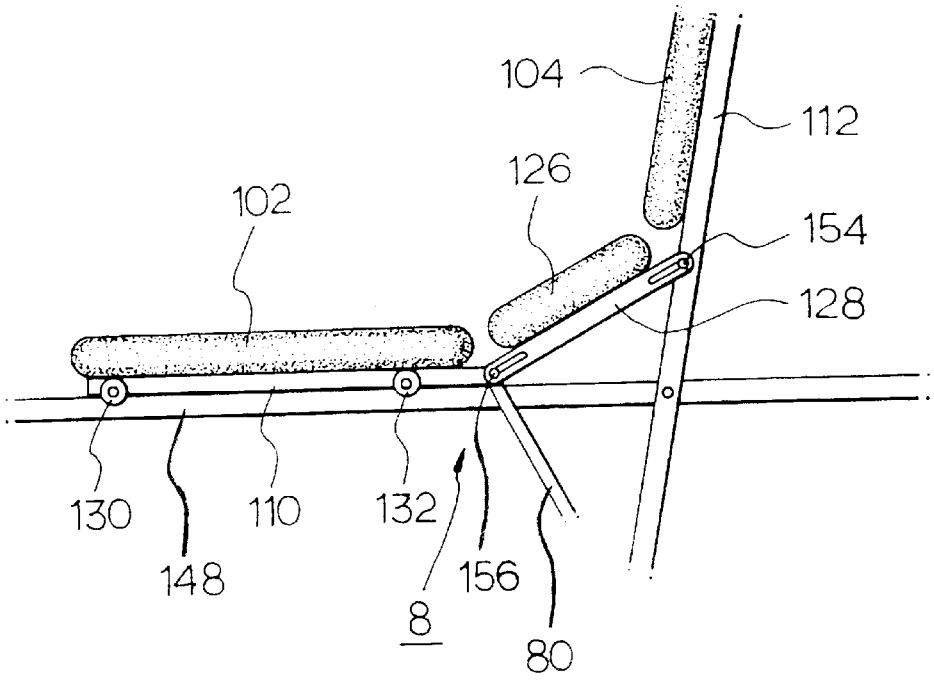
Figure 26:
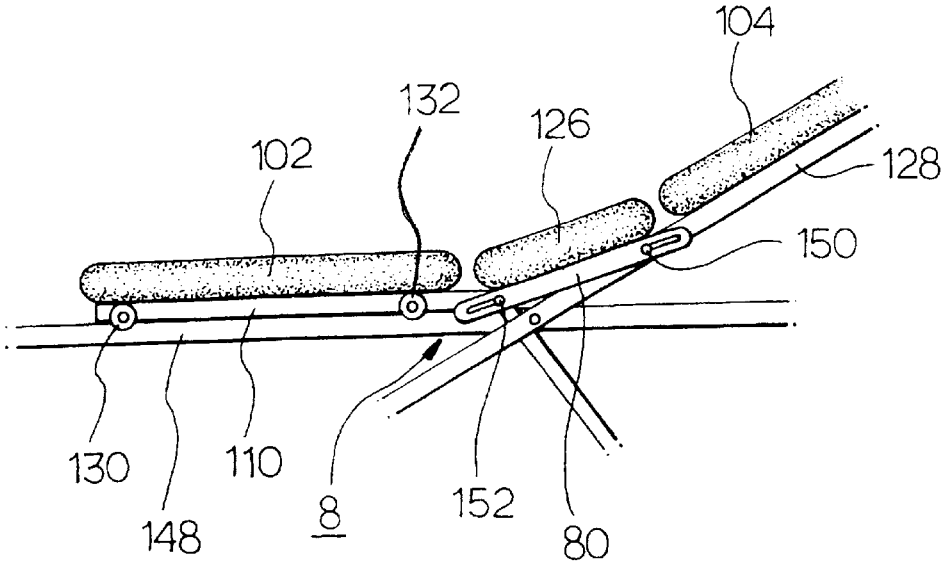
Figure 27:
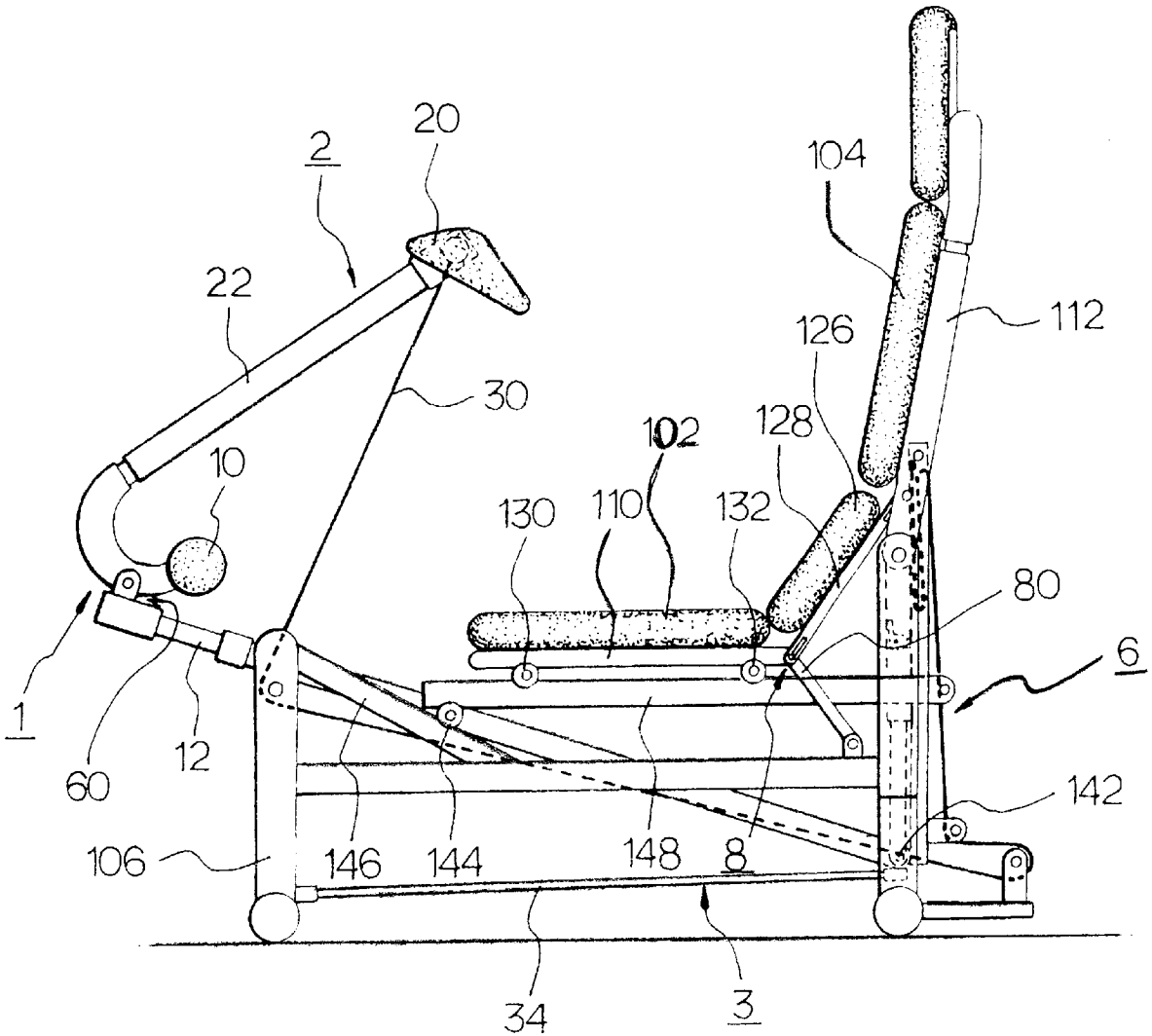

Referring to FIGS. 25 to 27, a shift preventing unit 8 is illustrated. The shift preventing unit 8 is connected between the connection portions of the seat plate 102 and back plate 104 of the seat unit 100. The shift preventing unit 8 is used in the case in which an assistant back plate frame 128 attached with an assistant back plate 126 is linked between the seat plate frame 110 of the seat plate 102 and the back plate frame 112 of the back plate 104 by hinges 154 and 156. In this case, front and rear rollers 130 and 132 are mounted on the seat plate frame 110 in such a manner that they slide on a lower frame such as slide support bars 148 hingably mounted to the back plate frame 112. The shift preventing unit 8 includes a pair of slots 82 and 84 formed at opposite ends of the assistant back plate frame 128. The hinges 154 and 156 are engaged in the slots 82 and 84, respectively. The shift preventing unit 8 also includes a shift adjusting link 80 hingably mounted at the lower end thereof to the fixed frame of the seat unit and at the upper end thereof to the hinge 156 of the seat frame 110.

The shift adjusting link 80 serves to limit the longitudinal shift of the seat frame 110 to a certain range. The slots 82 and 84 offset a shift of the seat plate 102 resulting from a variation in the angle of the back plate 104 occurring when the back plate 104 pivots forwardly or rearwardly. When the back plate 104 pivots forwardly as shown in FIG. 25, the hinges 154 and 156 are spaced away from each other. On the contrary, when the back plate 104 pivots rearwardly as shown in FIG. 26, the hinges 154 and 156 move toward each other. In either case, accordingly, the movement of the back plate 104 does not cause the seat plate 102, assistant back plate 126 and back plate 104 to be spaced away from adjacent ones. In other words, the seat unit 100 operates without any shift of its surface portions. The lower frame is not limited to the slide support bars 148. The shift preventing unit 8 may be appropriately applied to any exercise devices which have a fixed plate or other construction capable of supporting a seat plate. The shift preventing unit 8 also may be applied to any devices having a seat plate and a back plate and requiring a function of preventing the seat plate and back plate from being spaced beyond a desired range. For example, the shift preventing unit 8 illustrated in FIG. 27 may be effectively applied to medical treatment appliances or other devices including chairs.

Figure 4:
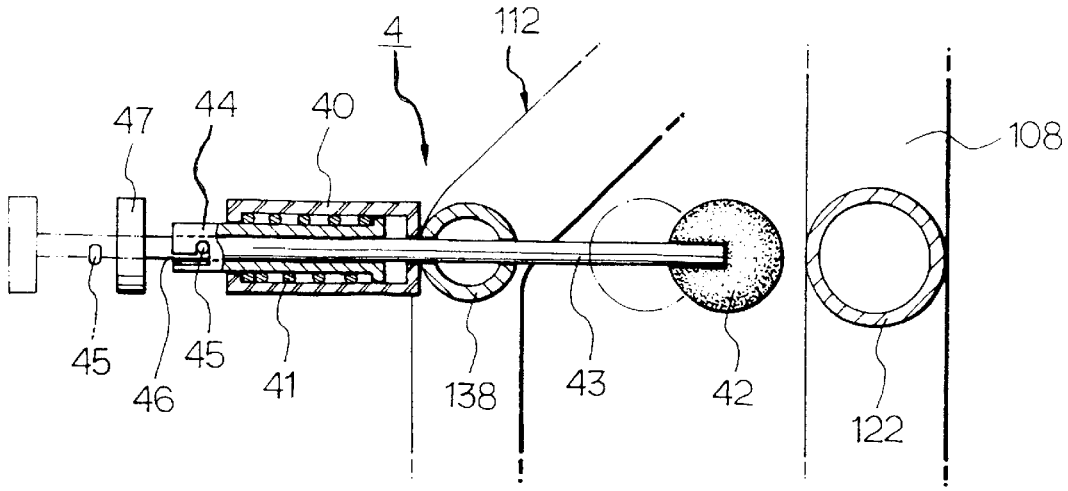
FIG. 4 is a sectional view showing the construction, arrangement and operation of the initial exercise thrust generating unit of FIG. 3.
Figure 28:
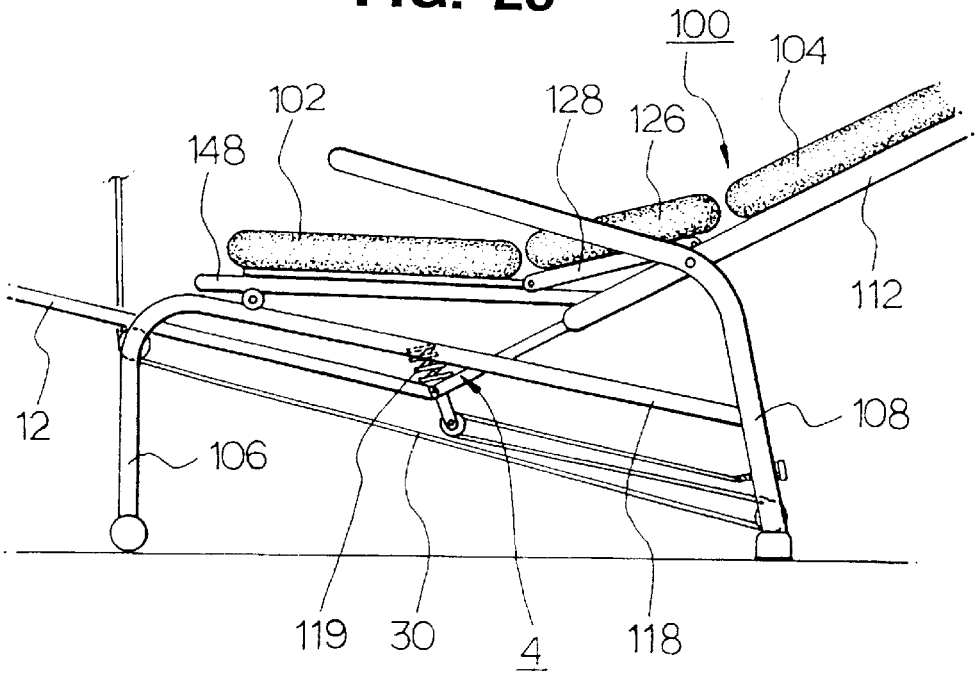
FIG. 28 is a side view of an initial exercise thrust generating unit in accordance with another embodiment of the present invention.

FIG. 28 illustrates a modified configuration of the initial exercise thrust generating unit 4 shown in FIGS. 3 and 4 in accordance with the present invention. In this case, the back plate frame 112 is hingably connected to the leg support bar 12. As shown in FIG. 28, the initial exercise thrust generating unit 4 includes a compression coil spring fixedly mounted to the lower or front end of the back plate frame 112 which is a movable frame of the seat unit 100. When a rearward force is applied to the back plate frame 112, thereby causing the back plate frame 112 to pivot downwardly, the compression coil spring comes into contact with a fixed bar 119 connected between the longitudinal bars 118, so that it is compressed. As a result, a resilience urging the back plate frame 112 to pivot upwardly is generated. This resilience serves as a thrust when an exercise is initiated.

FIG. 29, FIGS. 30 to 34, FIGS. 35 to 39, and FIGS. 40 to 42 are modified configurations of the repeated extension/retraction exercise unit shown in FIGS. 9 to 14, respectively. These modified repeated extension/retraction exercise units will now be described in a sequential manner.

Figure 29:
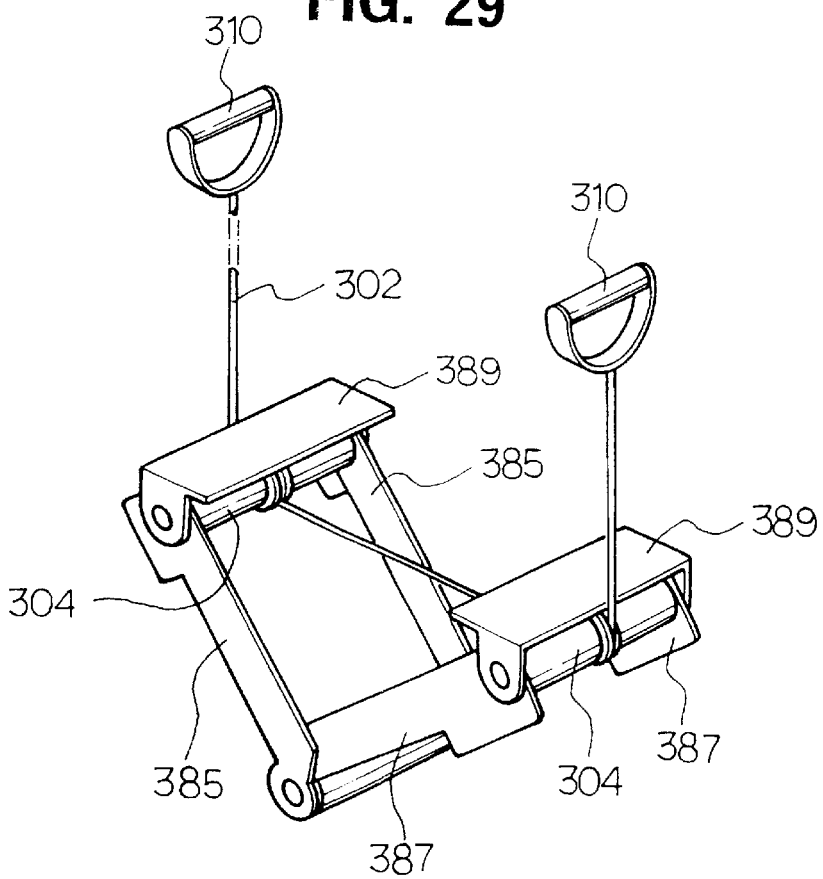
FIG. 29 is a perspective view of a repeated extension/retraction exercise unit in accordance with another embodiment of the present invention.
Figure 45:
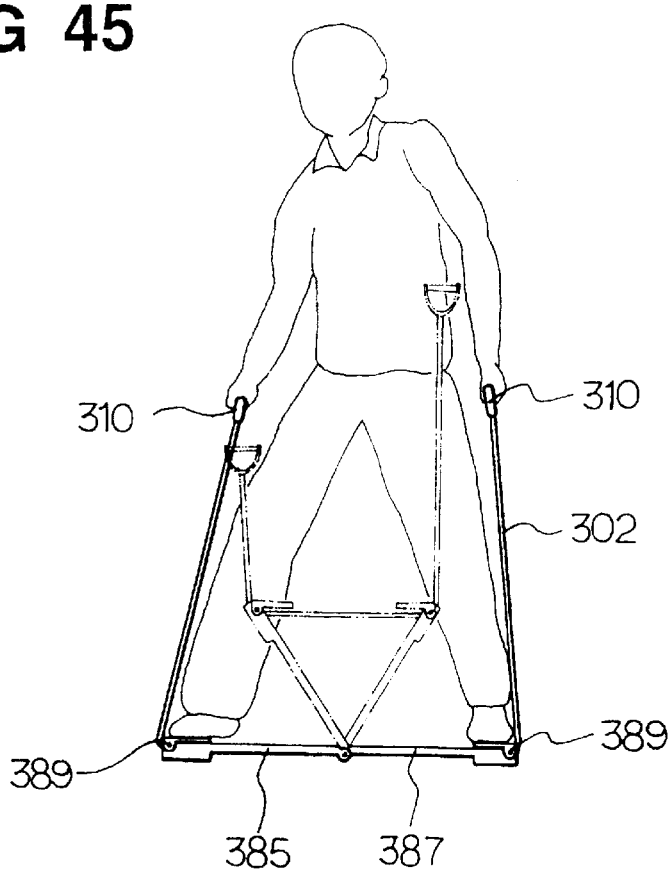
FIG. 45 is a view showing the operation of the repeated extension/retraction exercise unit of FIG. 29.

In the case of FIG. 29, a rope 302 is used as the load transmission unit. The rope 302 extends via a pair of direction change rollers 304 and has grips 310 having the shape of a foot holder at opposite ends thereof, respectively. One of the direction change rollers 304 is mounted at its opposite ends to a pair of frames 385 whereas the other direction change rollers 304 is mounted at its opposite ends to a pair of frames 387. The frames 385 and 387 are hingably connected together at their ends opposite to the ends mounting the direction change rollers 304. A pair of footholds 389 are hingably mounted to the ends of the frames 385 and 387 mounting the direction change rollers 304, respectively. When the rope 302 is drawn at one end thereof by drawing the associated grip 310, its length at the other end thereof is reduced. When the grip 310 at the other end of the rope is drawn, the rope 302 decreases in length at the other end thereof increases while increasing in length at one end thereof. Thus, the user can carry out a repeated extension/retraction exercise under the condition in which the user treads on the footholds with his feet, as shown in FIG. 45, while optionally adjusting the exercise load at each end of the rope 302.

In the cases of FIGS. 30 to 34 and FIGS. 35 to 39, a pair of ropes 302 are used as the load transmission unit. The ropes 302 extend via a pair of rollers 304 adapted for a rope guide and direction change in a crossing manner. A grip 308 and a foot holder 306 are fixed to opposite ends of each rope 302. In this configuration, the movement directions of the grips 308 cross the movement directions of the foot holders 306. The foot holders 306 are configured to carry out linearly reciprocating movements or to repeated rotating movements in a circumferential direction.

In the case of FIGS. 30 to 34, a configuration is used which enables linear reciprocating movements of the foot holders 306 using a rope 302 extending via a roller 392 or reciprocating movements of the foot holders 306 and grips 308 using ropes 302 extending via rollers 392 in a crossing manner. In order to enable linearly reciprocating movements of the foot holders 306, a slider 396 is provided which is received in a support bar 394. A connecting bar, which connects the foot holders 306, is also received in the support bar 394 so that it slides along the slider 396. In the support bar 394, a pair of triple rollers 392 are mounted to the front portion of the support bar 394. A fixing unit 398 may be provided at the front end of the support bar 394 opposite to the portion mounted with the rollers 392. The fixing unit 398 includes a vertical fixed bar 402 to which the front end of the support bar 394 is hingably mounted. The vertical fixed bar 402 is provided at the upper portion thereof with a vertical slot 404 and at the lower portion thereof with a plurality of fixing holes 406 for adjusting the height of the vertical fixed bar 402. A fixing plate 408 is separably coupled to the lower end of the vertical fixed bar 402. A locking unit 398 is disposed in front of the vertical fixed bar 402. The locking unit 398 includes a body 412, an upper member 410 hingably coupled to the upper end of the body 412, and a lower member 420 hingably coupled to the lower end of the body 412, An upper fixing member 416 is fitted in the upper end of the upper member 410 in such a manner that it slides vertically. A compression coil spring 414 is fitted around the upper member 410 to always urge the upper fixing member 416 upwardly. The upper fixing member 416 has a horizontal extension received in the vertical slot 404 to guide the vertical slide movement of the upper fixing member 416. The lower member 420 has an upward extension serving as a handle 422. A locking pin 424 is fixed to the lower end of the lower member 420. The locking pin 424 is engaged in a selected fixing hole 406 of the vertical fixed bar 402 so that the vertical fixed bar 402 is fixed at a desired level. Where the repeated extension/retraction exercise unit having the above mentioned configuration is to be installed on a bed or other appropriate place, for example, between upper and lower fixed lateral bars 426 and 428, the fixing plate 408 is seated on the lower fixed lateral bar 428 under the condition in which it is coupled to the lower end of the vertical fixed bar 402. Thereafter, the upper fixing member 416 of the locking unit 398 is engaged with the upper fixed lateral bar 426. In this state, the locking pin 424 is engaged in a selected fixing hole 406 corresponding to a desired level of the vertical fixed bar 402. The user then pivotally moves the handle 422 in such a manner that the upper and lower members 410 and 420 align with each other, as indicated by the double-dotted line in FIG. 34. Thus, the vertical fixed bar 402 is firmed fixed by the resilience of the compression coil spring 414 and the arrangement of aligned upper and lower members 410 and 420.

Figure 30:
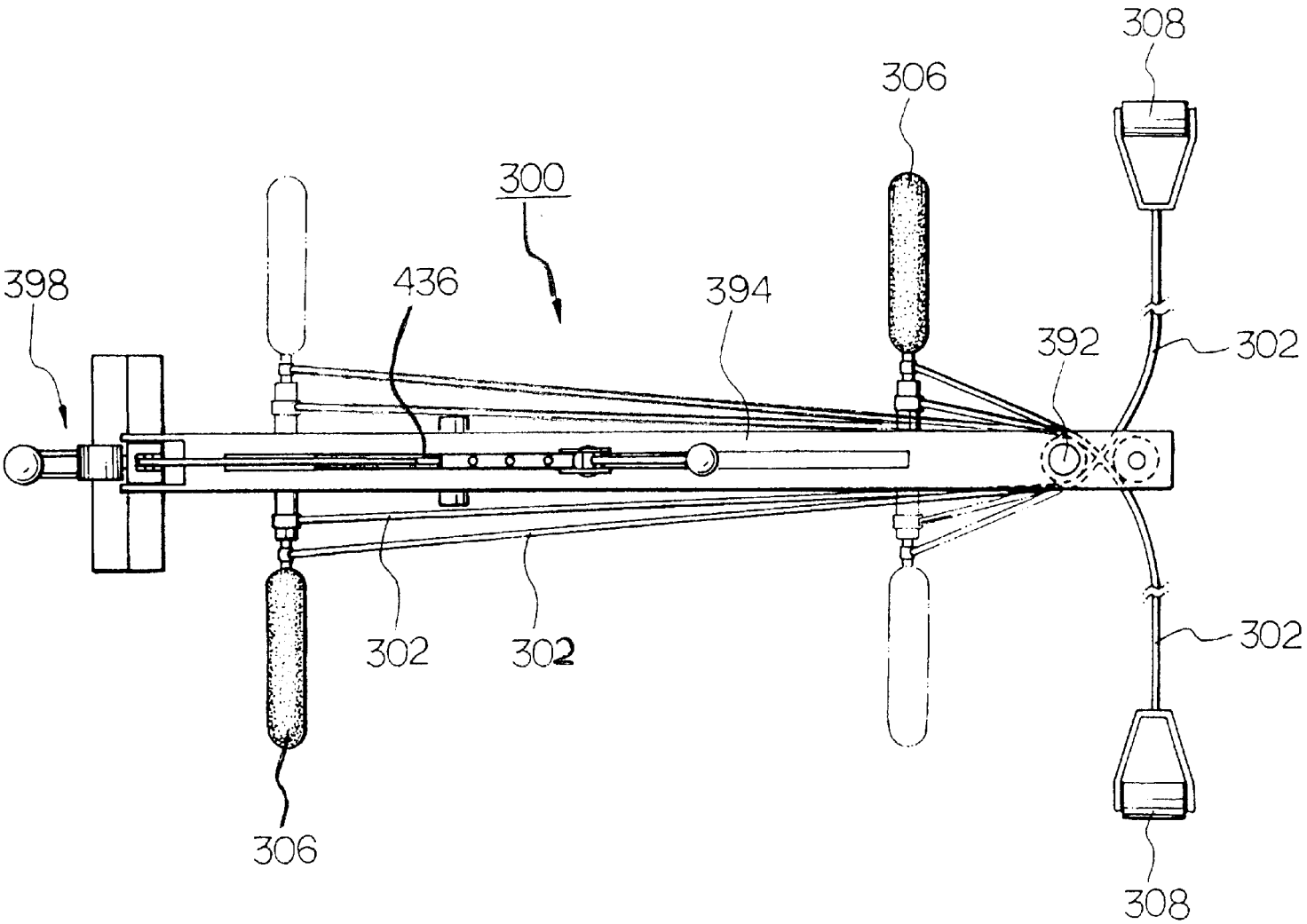
Figures 31, 32:
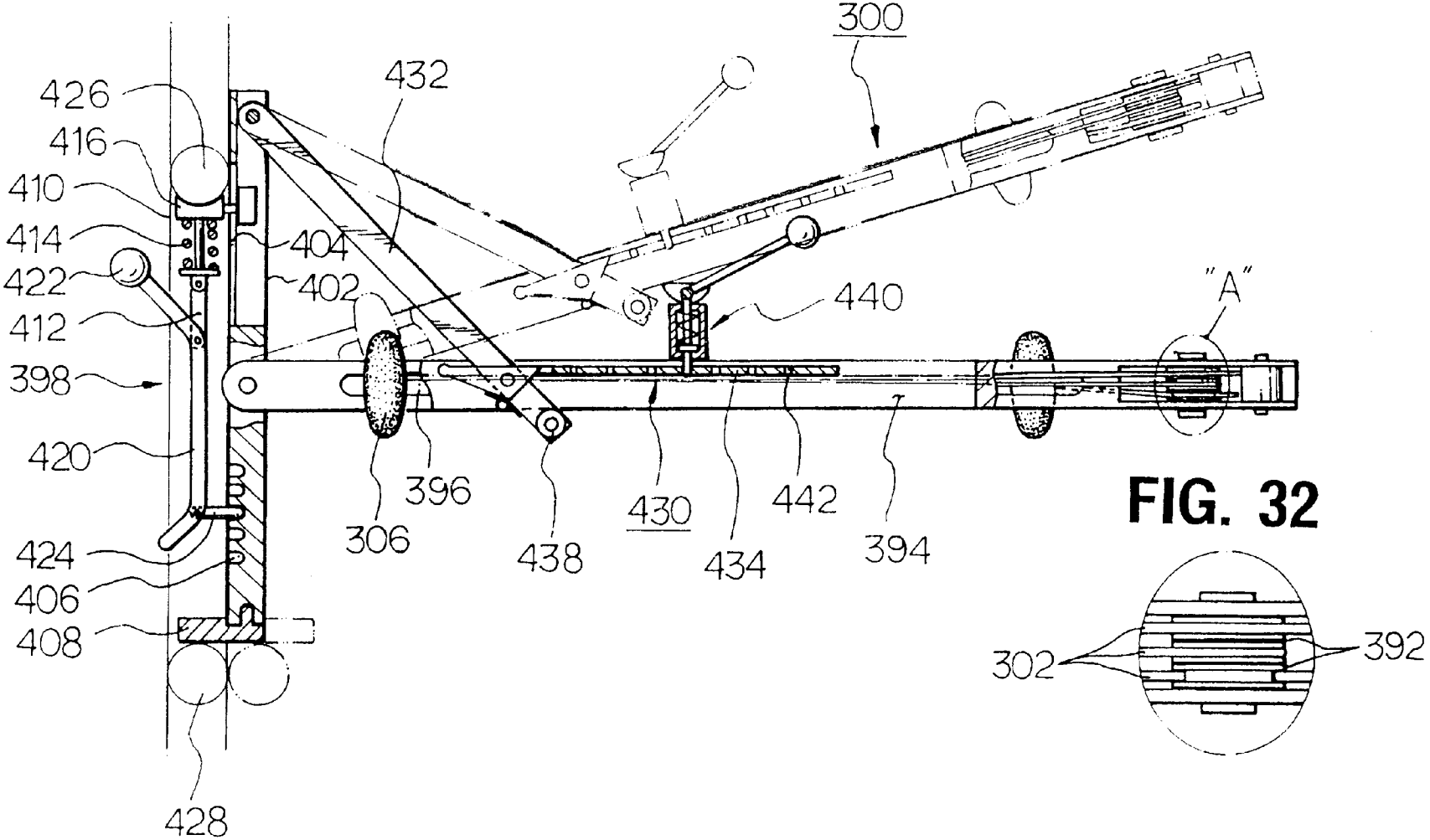

A shift unit 430 may be installed between the support bar 394 and vertical fixed bar 402 in order to shift the support bar 394 with respect to the vertical fixed bar 402. As shown in FIGS. 30 and 31, the shift unit 430 includes a control link 432 is hingably mounted at the upper end thereof to the upper end of the vertical fixed bar 402. The control link 432 is also hingably mounted at the lower portion thereof to the front end of the slider 434 which slides horizontally in the support bar 394. The lower end of the control link 432 extends through upper and lower longitudinal slots 436 formed in the support bar 394. A slide roller 438 is mounted to the lower end of the control link 432 so as to achieve a smooth slide movement of the control link 432 along the lower surface of the support bar 394. The slide 434 has a plurality of fixing holes 442 at the rear portion thereof. A control knob unit 440 is fixedly mounted on the upper surface of the support bar 394 in such a manner that it engages in a selected fixing hole 442 of the slider 434. Where it is desired to upwardly shift the support bar 394 from its horizontal position, the locking state of the control knob unit 390 is first released. In this state, the user upwardly moves the support bar 394 about its hinge, so that the control link 432 moves rearwardly along with the slider 434. When the support bar 394 is shifted to a desired position, the slider 434 is locked by the control knob unit 440. Thus, the support bar 394 is locked at a desired position.

In the case of FIGS. 35 to 39, a pair of rotating discs 450 are rotatably mounted on opposite ends of a central shaft 448 fixed to a vertical fixed bar 446 supported on a base frame 444. Foot holders 306 are mounted to desired portions of the rotating discs 450, respectively, in such a manner that they are radially opposite to each other, so as to achieve repeated circumferential-rotating movements thereof. A support bar 394 is hingably mounted to the vertical fixed bar 446 between the rotating discs 450. A pair of double rollers 302 is rotatably mounted to the front end of the support bar 394. A seat plate 460 is installed on the front portion of the base frame 444. In this case, a pair of ropes 302 extend via the rollers 392 in a crossing manner. A grip 308 and a foot holder 306 are fixed to opposite ends of each rope 302.

The seat plate 460 may be configured to be laterally movable and/or rotatable by slidably mounting a lateral seat frame 452 of the seat plate 460 to the base frame 444 while urging the seat frame 452 by compression coil springs 454 and/or rotatably mounting the seat frames 452 on the base frame 444 by means of a central vertical shaft 456 centrally mounted to the seat frame 452. It is also possible to configure the seat plate 460 to be longitudinally movable by the combination of a slider 458 fixedly mounted to the seat plate 460 and a control knob unit 461 adapted to lock the slider 458. The seat plate 460 having such a configuration may be applied to the repeated extension/retraction exercise device shown in FIG. 34, along with the base frame 444.

Figure 39:
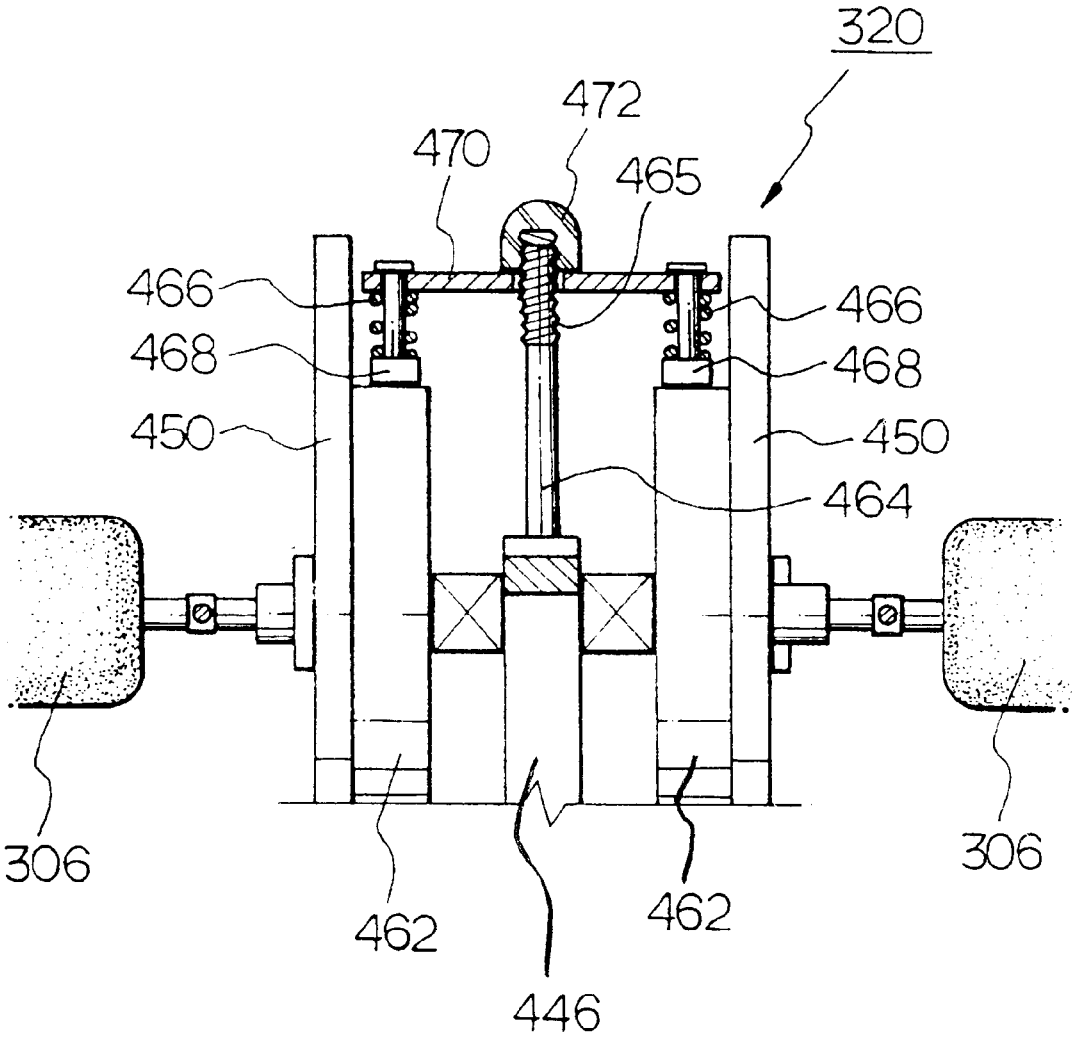

A load adjusting unit 320 may also be provided. The load adjusting unit 320 includes a pair of frictional discs 462 each attached to the inner surface of the associated rotating disc 450 operatively connected to the rope 302. As shown in FIG. 39, a fixing rod 464 is fixed at the lower end thereof to the upper end of the vertical fixed bar 446. The fixing rod 464 has a threaded upper end. A lateral bar 470 is fitted around the threaded upper end of the fixing rod 464. A pair of brake shoes 468 are vertically slidably mounted to opposite ends of the lateral bar 470 such that they are in contact with the peripheral surfaces of the frictional discs 462, respectively. The brake shoes 468 are always upwardly urged by compression coil springs 466, respectively. A cap nut 472 is threadedly coupled to the upper end of the fixing rod 464 so as to adjust the pressure of the brake shoes 468 against the frictional discs 462. When the cap nut 472 tightens, the lateral bar 470 moves downwardly, thereby compressing the springs 466. As a result, the resilience of the springs 466 is applied to the frictional discs 462 via the brake shoes 468, respectively. In this case, accordingly, an increased load is applied to the rotating discs 450, thereby increasing an exercise load. Thus, it is possible to adjust an exercise load applied to the foot holders 306.

Figure 33:
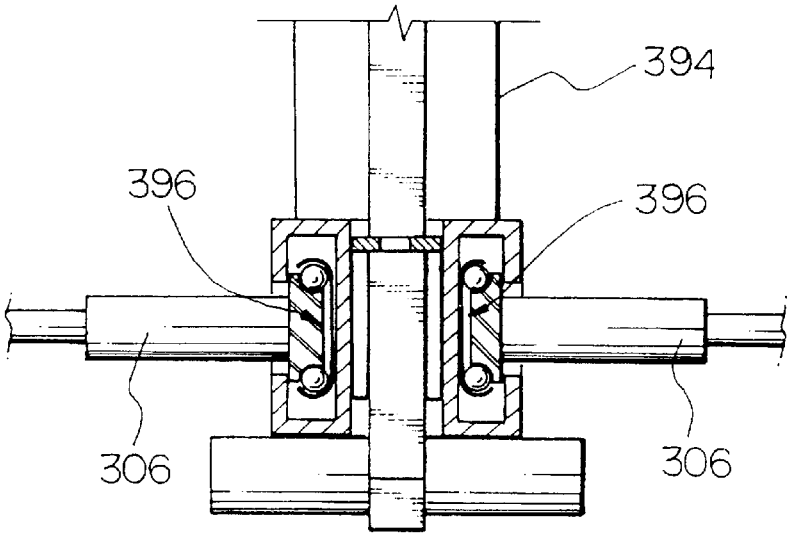
Figure 34:
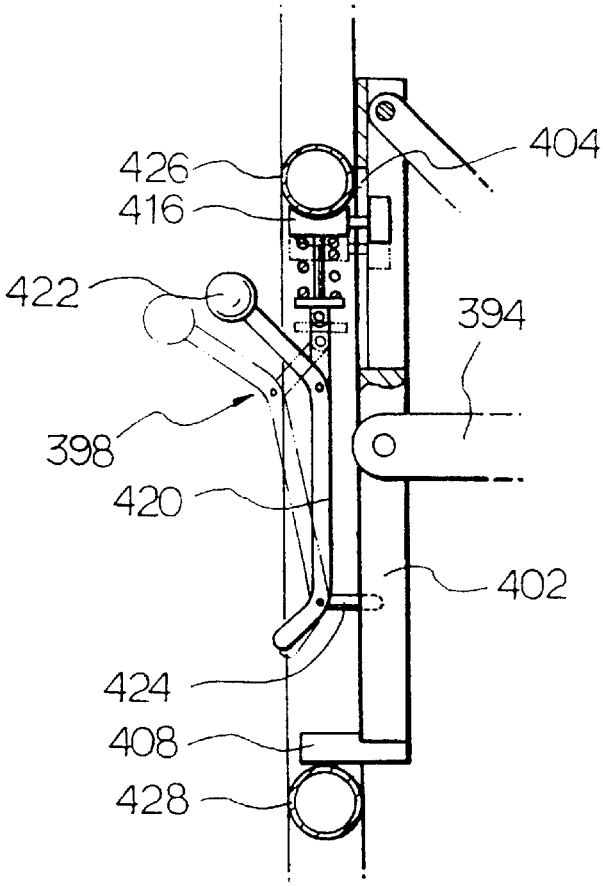
Figure 35:
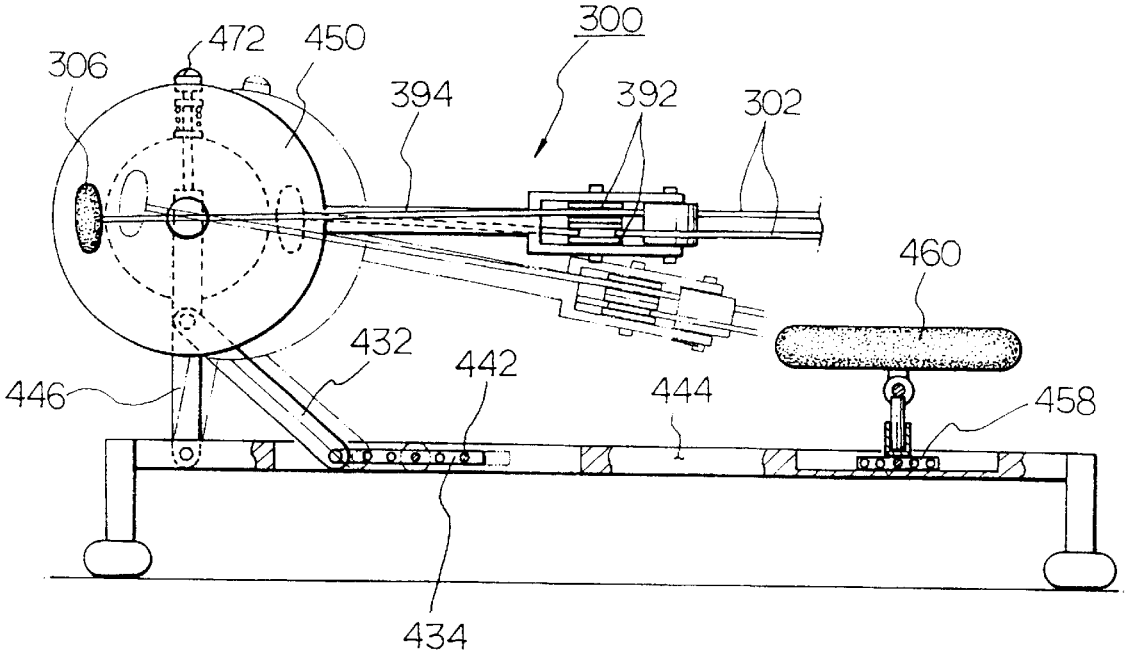
Figure 36:
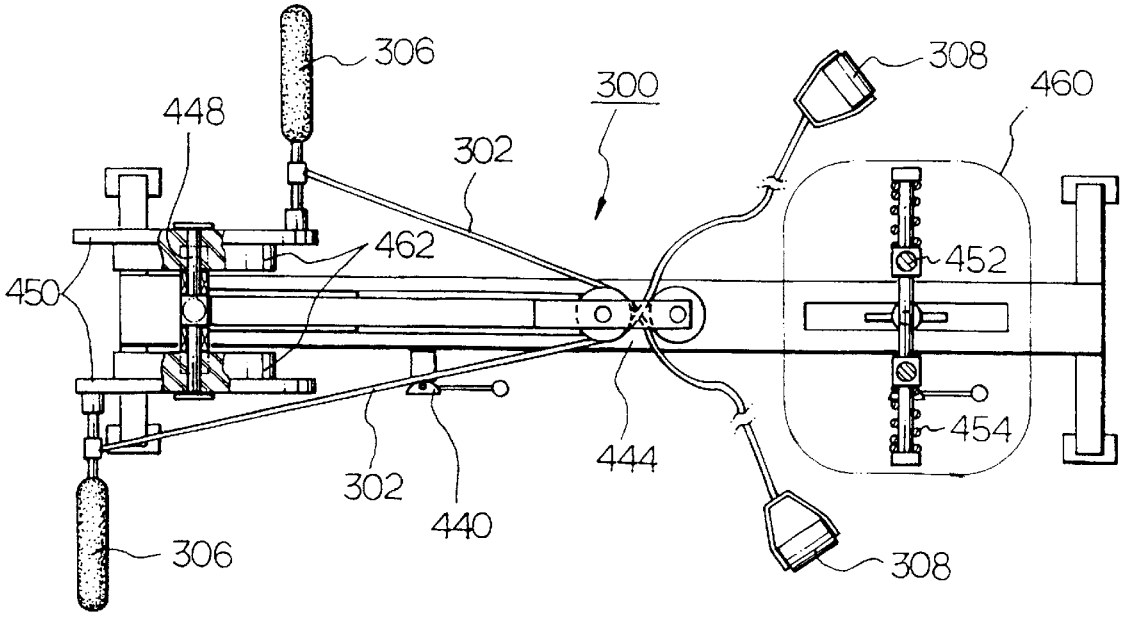
Figure 37:
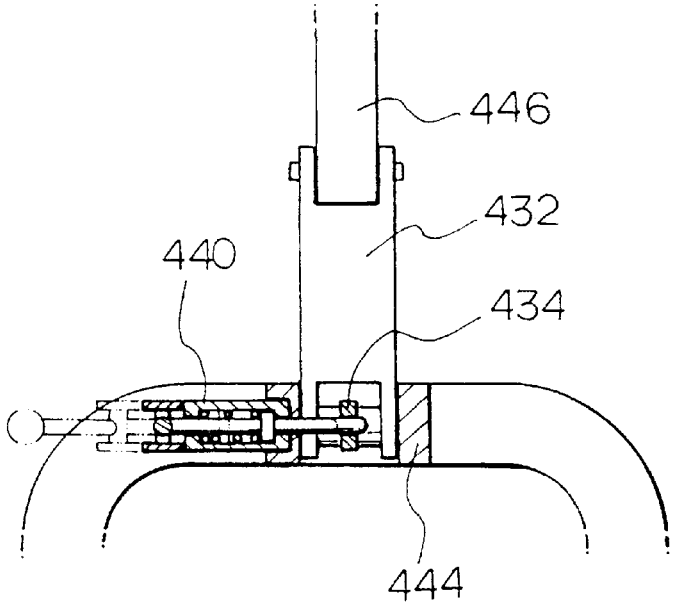
Figure 38:
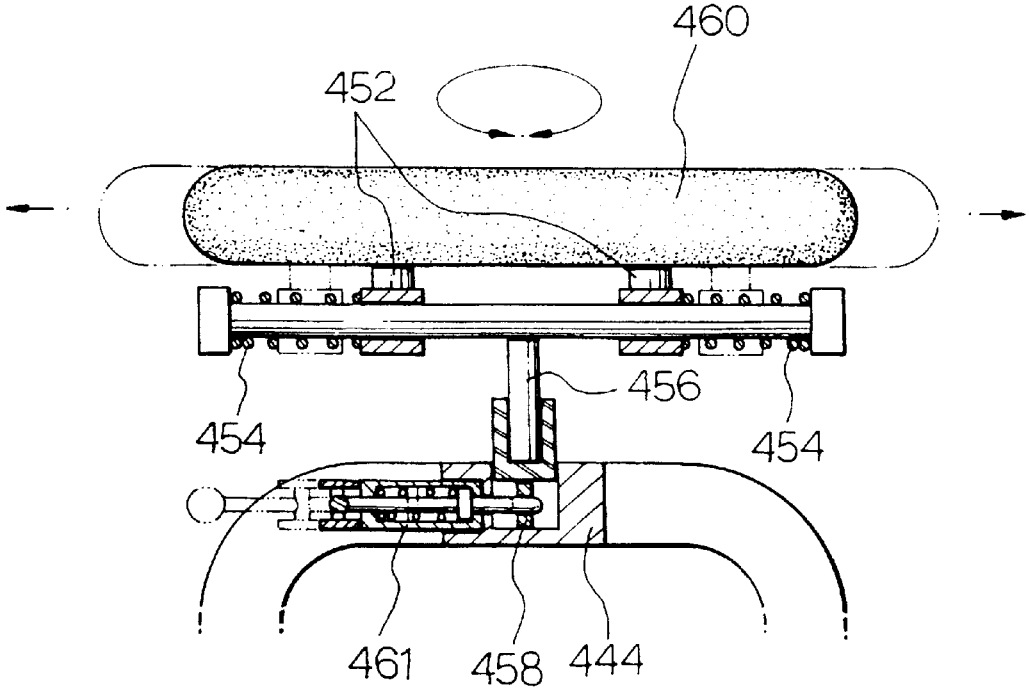

In this case, a separate shift unit 430 may be provided in the same manner as the case of FIGS. 31 and 33. The shift unit 430 may be connected between the vertical fixed bar and base frame 444 which are hingably coupled to each other as in the case of FIGS. 31 and 33. As in the case of FIGS. 28 and 29, the shift unit 430 includes a control link 432 hingably mounted at the upper end thereof to the upper end of the vertical fixed bar 446. The control link 432 is also hingably mounted at the lower portion thereof to the front end of the slider 434 which slides horizontally in the support bar 394. The slide 434 has a plurality of fixing holes 442 at the rear portion thereof. A control knob unit 440 is fixedly mounted on the side portion of the base frame 444 in such a manner that it engages in a selected fixing hole 442 of the slider 434.

Where it is desired to shift the vertical fixed bar 446, the locking state of the control knob unit 390 is first released. In this state, the user forwardly and downwardly moves the vertical fixed bar 446 about its hinge, so that the control link 432 moves rearwardly along with the slider 434. When the support bar 394 is shifted to a desired position, the slider 434 is locked by the control knob unit 440. Thus, the support bar 394 is locked at a desired position.

Where only one of the ropes 302 is used in the case of the exercise device illustrated in FIGS. 30 to 34, it is possible to achieve a repeated exercise for feet using the foot holders 306. Where both the ropes 302 are used, it is possible to achieve a repeated crossing exercise using the foot holders 306 and grips 308. In the case of the exercise device illustrated in FIGS. 35 to 39, a repeated rotating/crossing exercise can be achieved using the foot holders 306 and grips 308. In particular, where the seat plate 460 is also used in the exercise device of FIGS. 35 to 39, it is also possible to achieve a laterally moving and rotating exercise of the upper body. Thus, it is possible to achieve an exercise for the body such as an exercise for the latissimus dorsi muscle and an exercise for the dorsal muscle.

Figure 40:
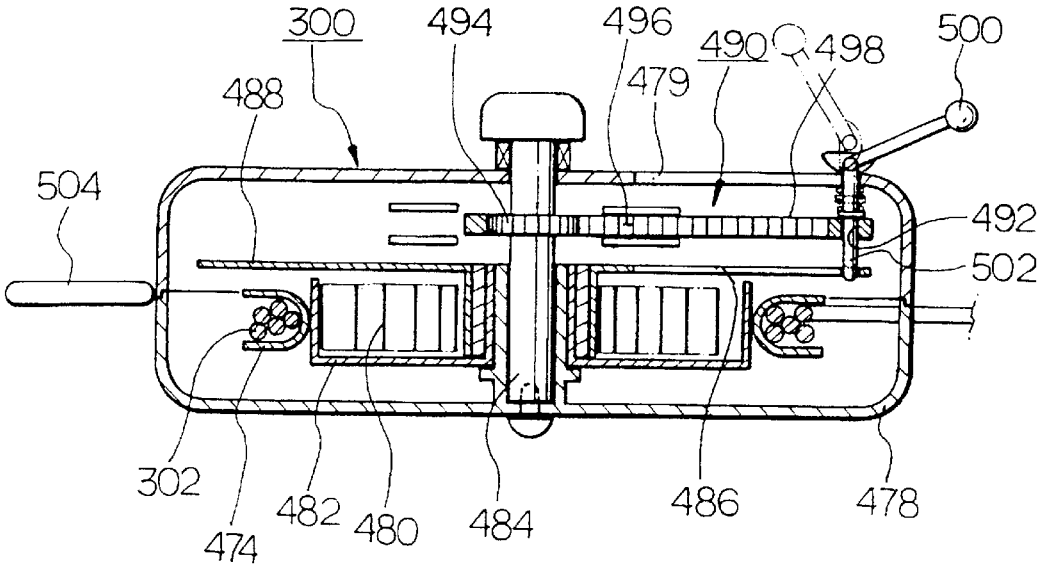
Figure 41:
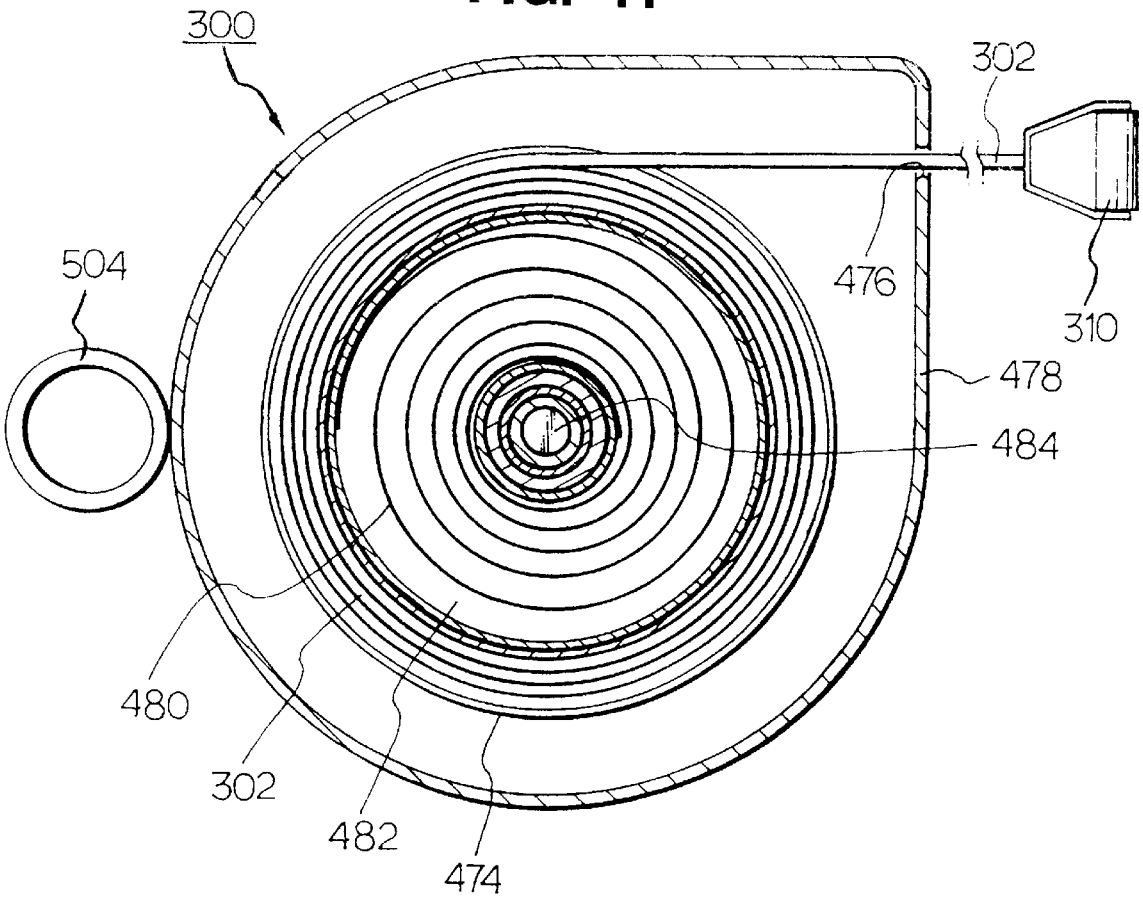
Figure 42:
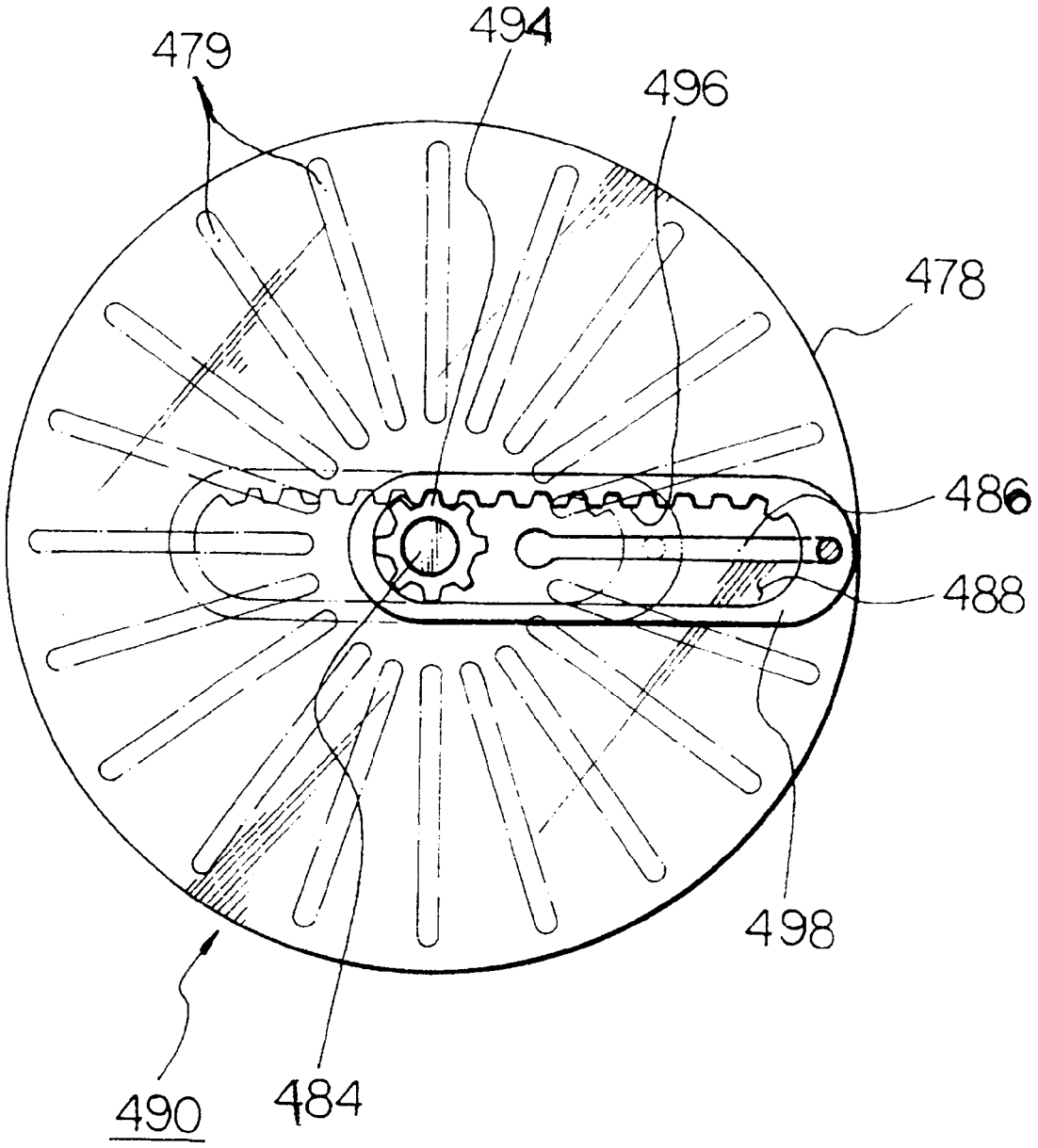
Figure 43:
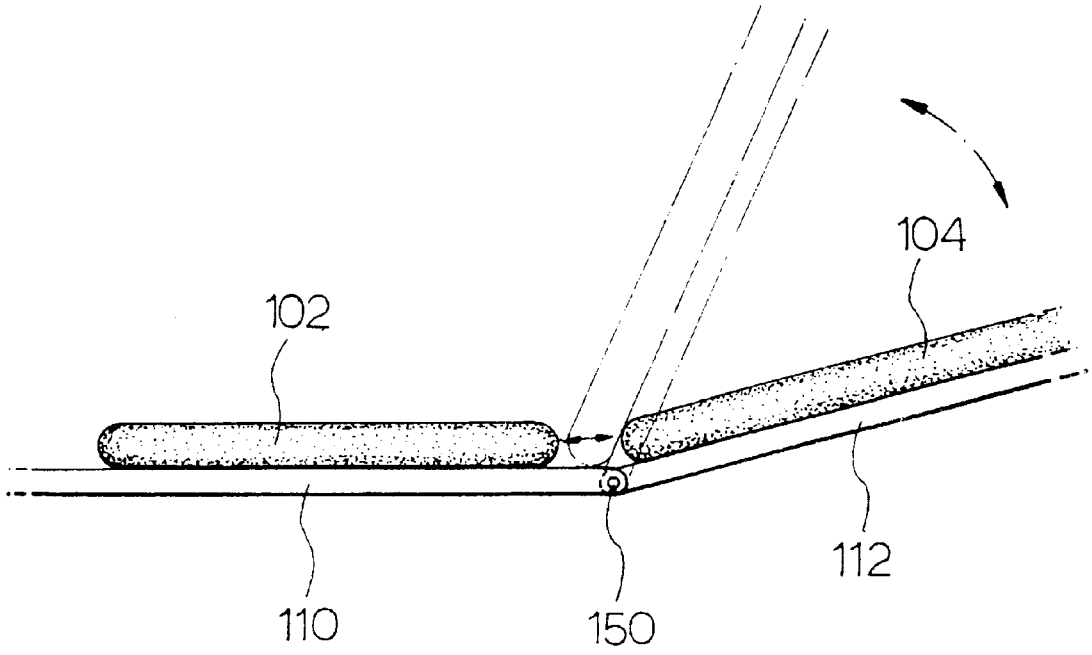
FIG. 43 is a side view showing a typical connection part for connecting both a seat plate and a back plate to the seat unit of an exercise device.

FIGS. 40 to 42 illustrate a modified configuration of the repeated extension/retraction exercise device. In this case, a rope 302 is used as the load transmission unit. A roller type holder 474, which is adapted for a variation in the length of the rope 302 or a storage of the rope 302, is coupled to a drum 482 of a load unit 480 equipped with a spiral spring. The drum 482 is rotatably mounted on a central shaft 484 fixed to the central portion of an outer casing 478. The rope 302 is fixed at one end thereof to the holder 474. The other end of the rope 302 is connected to a grip 310 having the form of a foot holder. The load unit 480 is fixedly mounted at one end thereof to the drum 482 and at the other end thereof to the load adjusting unit 490. As the user pulls or releases the rope 302, the exercise load of the load unit is transmitted to the grips 310 while the rope 302 is unwound from the holder 474 or wound on the holder 474.

The load adjusting unit 490 includes a control plate 488 fitted at the central portion thereof around the central portion of the drum 482. The control plate 488 is fixedly connected at the lower end thereof to the load unit 480 and provided at the upper end thereof with a circular plate having a plurality of radial slots 486. The load adjusting unit 490 also includes a ring-shaped slider 498 having a rack 496 at the inner surface thereof. The rack 496 engages with a pinion 494 fixedly mounted to the middle portion of the central shaft 484. The slider 498 also has a though hole 492 at one end thereof. A control knob 500 is also provided which has a locking pin 502 extending through a radial slot 479 formed in the outer casing 478 and the through hole 492 and serving to engage in a selected one of the slots 486 of the control plate 488. The shape of the slots 486 may be optionally selected in so far as the locking pin 502 can engage in and disengage from a selected one thereof. The outer casing 478 may have a rope hole 476 and a fixing member 504 arranged at a position opposite to the rope hole 476.

The load adjusting unit 490 may be independently installed at a place, where the direction change rollers 304 of the seat unit 100 is installed, or other appropriate place, using the outer casing 478 or fixing member 504. When the user pulls the rope 302 using the grips 310 under the condition in which the locking pin 502 of the control knob 500 engages in a selected one of the slots 486, as shown in FIG. 28, the holder 474 and drum 482 rotate about the central shaft 484. In this state, the resilience of the spiral spring 480 is completely transmitted to the rope 302 because the spiral spring 480 is connected between the drum 482 and the control plate 480 which can not rotate. As a result, an exercise load is generated. When the central shaft 484 rotates along with the pinion 494 in the above state, the control knob unit 500 moves along with the slider 498 toward the central shaft 484 because its locking pin 502 is in a state engaged in the slider 498. In accordance with the moved position of the control knob unit 500, there is a variation in the distance between the position of the control plate. 488, where the spiral spring 480 is fixed, and the position of the slot 486, where the locking pin 502 engages. This variation results in a variation in the resilience of the spiral spring 480. Accordingly, it is possible to adjust the exercise load applied to the rope 302.

Where it is desired to adjust the length of the rope 302 outwardly extracted through the -rope hole 476, the user upwardly moves the locking pin 502 of the control knob unit 500, thereby releasing the engagement state between the locking pin 502 and the slot 486 of the control plate 488. As a result, both the control plate 488 and drum 482 can freely rotate. In this state, the length of the rope 302 can be adjusted by extracting or retracting an appropriate length of the rope 302. After this adjustment, the locking pin 502 of the control knob unit 500 engages in a selected one of the slots 486. A separate spring may be operatively connected to the drum or holder 474 in order to achieve a smooth winding of the rope on the holder 474 when the rope is retracted.

INDUSTRIAL APPLICABILITY

As apparent from the above description, the present invention provides an exercise device having a simple and inexpensive configuration including an exercise load unit connected to a movable knee hold unit, and a seat unit having a seat plate and a back plate which are selectively or completely movable during an exercise, irrespective of whether or not a leg support unit having foot holders is in a fixed state or in a movable state, thereby being capable of achieving a variety of exercises for the whole part of the human body using the upper body or lower body, or using both the upper and lower bodies. The exercise device may include an exercise load unit comprised of the weight of a user transmitted to a movable frame of the exercise device during an exercise or a variety of load units. In this case, the exercise load unit-is connected to a knee hold unit via a load transmission unit. Accordingly it is possible to selectively transmit an exercise load to knee holders in accordance with the direction of an exercise such as an extension or flection exercise. The exercise load unit may also include an initial exercise thrust generating unit connected between a movable frame of a seat unit and a fixed frame and adapted to generate a thrust for exercise at the initial stage of the exercise. The exercise device may also include a distance adjusting unit adapted to adjust the distances between a foot holder and a knee holder, between the knee holder and a seat plate and between the foot holder and seat plate in accordance with the lengths between the foot and knee of the user and between the knee and wrist joint. In this case, it is possible to meet the body length and shape of the user. The exercise device may also include an upper body flection/extension exercise unit adapted to achieve a flection or extension exercise for the upper body of the user, thereby achieving an exercise for the epigastric muscle of the user. A knee holder moving unit adapted to temporarily move knee holders may be also provided. In this case, it is possible to provide a space for allowing the user to sit down on the exercise device to carry out an exercise or to rise up from the seat plate 120 after the exercise. Where the exercise device includes a foot holder pressure adjusting unit, it is possible not only to achieve a flection exercise only using the knees of the user under the condition in which no considerable resistance is applied to the feet of the user, but also to achieve an exercise for the crook muscle of the user.

In particular, the exercise device may include a repeated extension/retraction exercise unit which can be used in combination with or independently of exercise devices according to the present invention. In this case, the repeated extension/retraction exercise unit includes an exercise load transmitting unit comprised of a rope or wire and being adjustable in length. Accordingly, it is possible to achieve an exercise for the body such as an exercise for the latissimus dorsi muscle and an exercise for the dorsal muscle in various exercise directions.

What is claimed is:

1. In an exercise device comprising a seat unit having a seat plate, a back plate, support legs and associated frames completely or selectively assembled together, a leg support unit having foot holders, and a knee hold unit having knee holders, the exercise device carrying out an exercise using the leg support unit and the knee hold unit in a sitting or lying status of a user, further comprising means for allowing the knee hold unit to be movable, and exercise load means connected to the movable knee hold unit, further comprising means for allowing the leg support unit to be selectively movable or fixed during an exercise, and means for allowing a selected one or all of the seat and back plates of the seat unit to be selectively movable or fixed during an exercise, the exercise load means is selectively connected to the weight of the user applied to a movable one of the frames or separate load means during the exercise, and the exercise load means is connected to the knee hold unit by a load transmission unit, wherein the exercise load means is adapted to selectively transmit an exercise load to the foot holders or the knee holders in accordance with the direction of an extension or flection exercise to be carried out about the wrist joints of the user.

2. The exercise device in accordance with claim 1, further comprising an initial exercise thrust generating unit arranged between a movable frame and a fixed frame of the seat unit at operatively connected portions of the frames.

3. The exercise device in accordance with claim 1, further comprising a distance adjusting unit adapted to adjust the distances between the foot holders and the knee holders, between the knee holders and the seat plate and between the foot holders and the seat plate in accordance with the lengths between the foot and the knee of the user, between the knee and the wrist joint of the user and between the foot and the wrist joint, thereby being capable of meeting the body length and shape of the user.

4. The exercise device in accordance with claim 3, wherein the distance adjusting unit comprises a connecting member comprised of a wire or a rope and connected between the foot holders and the seat plate and between the foot holders and the knee holders via a movable member to vary the distance between the foot holders and the seat plate and the distance between the foot holders and the knee holders in a desired ratio, and a locking member provided at a selected one of the operatively connected foot holders, seat plate, knee holders and connecting member to lock those elements in a distance adjusted state.

5. The exercise device in accordance with claim 1, further comprising an upper body flection/extension exercise unit connected to a back plate frame of the seat unit and adapted to achieve a flection or extension exercise for the upper body of the user.

6. The exercise device in accordance with claim 1, further comprising a repeated extension/retraction exercise unit connected to a selected frame of the seat unit, the repeated extension/retraction exercise unit comprising a rope, as the load transmission unit, extending via a pair of direction change rollers and having grips at opposite ends thereof, respectively, the rope decreasing in length at one end thereof when it is drawn at the other end thereof by drawing the associated grip while decreasing in length at the other end thereof when it is drawn at one end thereof by drawing the associated grip, thereby enabling the user to carry out a repeated extension/retraction exercise while optionally adjusting the exercise load at each end of the rope.

7. The exercise device in accordance with claim 1, further comprising a knee holder moving unit adapted to temporarily move knee holders, thereby providing a space for allowing the user to sit down on the exercise device to carry out an exercise or to rise up from the seat plate after the exercise.

8. The exercise device in accordance with claim 1, further comprising a foot holder pressure adjusting unit adapted not only to achieve a flection exercise only using the knees of the user, but also to achieve an exercise for the crook muscle of the user.

9. The exercise device in accordance with claim 1, further comprising a shift preventing unit adapted to prevent the seat and back plates of a seat unit from being spaced from each other when the angle defined between the plates varies.

10. In a repeated extension/retraction exercise device comprising a rope, as the load transmission unit, extending via a plurality of direction change rollers adapted for a rope length variation and a direction change and having grips at opposite ends thereof, respectively, the rope decreasing in length at one end thereof when it is drawn at the other end thereof by drawing the associated grip while decreasing in length at the other end thereof when it is drawn at one end thereof by drawing the associated grip, thereby enabling the user to carry out a repeated extension/retraction exercise while optionally adjusting the exercise load at each end of the rope, the repeated extension/retraction exercise device in accordance with the above said, wherein the load transmission unit comprises a pair of ropes extending via a pair of rollers adapted for a rope guide and a direction change in a crossing manner, each rope having a grip and a foot holder fixed to opposite ends of the rope, the movement directions of the grips crossing the movement directions of the foot holders while the foot holders being configured to carry out linearly reciprocating movements or to repeated rotating movements in a circumferential directions; and further comprising a seat plate configured to be laterally movable or rotatable.

11. The repeated extension/retraction exercise device in accordance with claim 10, further comprising a load adjusting unit operatively connected to the rope.

12. The repeated extension/retraction exercise device in accordance with claim 10, further comprising;

a roller type holder adapted for a variation in the length of the rope or a storage of the rope; an outer casing;

a drum coupled to the holder and rotatably mounted on a central shaft fixed to a central portion of an outer casing;

the rope fixed at one end thereof to the holder and at the other end thereof to a grip having the form of a foot holder;

a load unit having the form of a spiral spring, the load unit being fixedly mounted at one end thereof to the drum; and a load adjusting unit connected to the other end of the load unit;

whereby an exercise load of the load unit is transmitted to the grips while the rope is unwound from the holder or wound on the holder as the user pulls or releases the rope.

13. The repeated extension/retraction exercise device in accordance with claim 10, wherein the load adjusting unit comprises;

a control plate fitted at a central portion thereof around a central portion of the drum and fixedly connected at a lower end thereof to the load unit, the control plate having an upper end thereof a circular plate having a plurality of radial slots;

a ring-shaped slider having a rack at an inner surface thereof, the rack engaging with a pinion fixedly mounted to a middle portion of the central shaft, the slider also having a through hole at one end thereof; and a control knob having a locking pin extending through a radial slot formed in the outer casing and serving to engage in a selected one of the slots of the control plate.

14. The repeated extension/retraction exercise device 30 in accordance with claim 10, further comprising a rope length adjusting unit operatively connected to the rope.

* * * * *